US012241652B2

(12) United States Patent
Tsao et al.

(10) Patent No.: US 12,241,652 B2
(45) Date of Patent: Mar. 4, 2025

(54) NEGATIVE PRESSURE CONDENSATE DRAIN SYSTEM

(71) Applicant: RESEARCH PRODUCTS CORPORATION, Madison, WI (US)

(72) Inventors: Han-Chuan Tsao, Madison, WI (US); Matthew Gehl, Madison, WI (US)

(73) Assignee: Research Products Corporation, Madison, WI (US)

( * ) Notice: Subject to any disclaimer, the term of this patent is extended or adjusted under 35 U.S.C. 154(b) by 697 days.

(21) Appl. No.: 17/341,734

(22) Filed: Jun. 8, 2021

(65) Prior Publication Data

US 2022/0026105 A1 Jan. 27, 2022

Related U.S. Application Data

(60) Provisional application No. 63/056,844, filed on Jul. 27, 2020.

(51) Int. Cl.
*F24F 13/22* (2006.01)

(52) U.S. Cl.
CPC ..... *F24F 13/222* (2013.01)

(58) Field of Classification Search
CPC ..... F24F 13/222
See application file for complete search history.

(56) References Cited

U.S. PATENT DOCUMENTS

| | | | | |
|---|---|---|---|---|
| 4,835,984 | A * | 6/1989 | Vyavaharkar | F25D 21/14 62/291 |
| 5,152,154 | A * | 10/1992 | Sullivan | F24F 1/0007 220/571 |
| 11,105,531 | B2 * | 8/2021 | Stewart | F24F 1/0073 |
| 2011/0016903 | A1 * | 1/2011 | Ballet | F24F 13/222 62/276 |
| 2013/0276471 | A1 * | 10/2013 | Austin | F25D 21/14 220/571 |

FOREIGN PATENT DOCUMENTS

CN 103512180 1/2014

OTHER PUBLICATIONS

Translation CN103512180 (Year: 2014).*

* cited by examiner

*Primary Examiner* — Filip Zec
(74) *Attorney, Agent, or Firm* — Foley & Lardner LLP

(57) ABSTRACT

A drain pan system for receiving, routing, and draining condensate from a dehumidifying, heating, ventilating, or air conditioning system is disclosed. The system includes a drain pan body that contains one or more walls to mitigate air flow and enable smooth condensate flow into, through, and out of the drain pan system.

13 Claims, 21 Drawing Sheets

NEGATIVE PRESSURE CONDENSATE DRAIN SYSTEM

CROSS-REFERENCE TO RELATED APPLICATIONS

The present application claims priority to U.S. Provisional Application No. 63/056,844, filed Jul. 27, 2020, which is incorporated by reference herein in its entirety.

BACKGROUND

The present application relates generally to the field of condensate drain pan systems. More specifically, the present disclosure relates to managing condensate drainage from a dehumidifier or heating, ventilation, and air conditioning (HVAC) components under negative pressure.

Drain pan designs often manage condensate drainage using a plumbing trap or "p-trap" structure; however, such designs can be prone to leakage resulting from water entrainment and/or air backflow through a drain opening in the drain pan. In addition, the p-trap can become dried out or clogged, thereby reducing its effectiveness.

It would be advantageous to provide a condensate drainage system for a dehumidifier or HVAC components that can effectively manage condensate drainage and prevent leakage without the use of a p-trap.

SUMMARY

According to an exemplary embodiment of the present disclosure, a drain pan system for a condensate-generating apparatus includes a first wall, a second wall, wherein each of the first wall and the second wall is positioned substantially perpendicular to a bottom surface, and wherein each of the first wall and the second wall has a first height. The drain pan system further includes a first channel defined by the first wall and the second wall and has a first end and a second end. The drain pan system also includes a third wall having a second height, wherein the second height is greater than the third height. The drain pan system further includes a well and an opening fluidly coupled to the well, wherein the well is fluidly coupled to each of the first wall, the second wall, and the first channel, According to an exemplary embodiment of the system, the first channel has a first depth, wherein the first depth corresponds to a distance between the bottom surface and a top edge of the first wall.

According to an exemplary embodiment, the system further includes a second channel defined by the second wall and fourth wall, wherein the fourth wall is disposed between the second wall and third wall.

According to an exemplary embodiment of the system, the second channel has a second depth, wherein the second depth corresponds to a distance between a bottom surface and a top edge of the second wall.

According to an exemplary embodiment of the system, the second channel depth is less than the first channel depth.

According to an exemplary embodiment of the system, the second wall is substantially equidistant from the first wall and the fourth wall.

According to an exemplary embodiment, the system further includes a third channel defined by the fourth wall and the third wall.

According to an exemplary embodiment, the system further includes an insert component coupled between the well and the opening, wherein the insert component is configured to control a flow of condensate through a drain opening.

According to an exemplary embodiment of the present disclosure, a drain pan system, includes: a breakwater region having a sloped bottom surface, a wall adjacent to the breakwater region, a well fluidly coupled to the breakwater region, an opening fluidly coupled to the well, and an insert component positioned between the well and the opening.

According to an exemplary embodiment of the system, the breakwater region includes a first end and a second end, and wherein the second end is connected to the well.

According to an exemplary embodiment of the system, the first end corresponds to a first depth and the second end corresponds to a second depth, and wherein the first depth is less than the second depth.

According to an exemplary embodiment of the system, the insert component comprises a handle, a horizontal portion connected to the handle, and an angled portion connecting the horizontal portion to vertical portion, wherein the vertical portion is connected to a slanted portion of the insert component.

According to an exemplary embodiment of the system, the slanted portion includes a first section and a second section, and wherein the first section is positioned within the opening.

According to an exemplary embodiment, the system further includes a first wall and a second wall disposed within the breakwater region, wherein the first wall and the second wall define a channel there between.

According to an exemplary embodiment of the system, each of the first wall, the second wall, and the channel are fluidly coupled to the well.

According to an exemplary embodiment, a system includes a condensate generating apparatus and a drain pan. The condensate generating apparatus includes: an evaporator having a first location and a second location, a condenser; and a third location defined by a space between the evaporator and the condenser. The drain pan includes: a first wall having a first position corresponding to the first location, a second wall having a second position corresponding to the second location, a channel defined by the first wall and the second wall, a third wall having a third position corresponding to the third location, a well fluidly coupled to each of the first wall, the second wall, and the channel, and an opening fluidly coupled to the well.

According to an exemplary embodiment of the system, each of the first wall and the second wall have a same first height.

According to an exemplary embodiment of the system, the third wall has a second height, and wherein the second height is greater than the first height.

According to an exemplary embodiment of the system, the drain pan further comprises an insert component positioned between the well and the opening.

According to an exemplary embodiment of the system, the insert component comprises a handle, a horizontal portion connected to the handle, and an angled portion connecting the horizontal portion to a vertical portion, wherein the vertical portion is connected to a slanted portion of the insert component.

DETAILED DESCRIPTION

Figure 1:
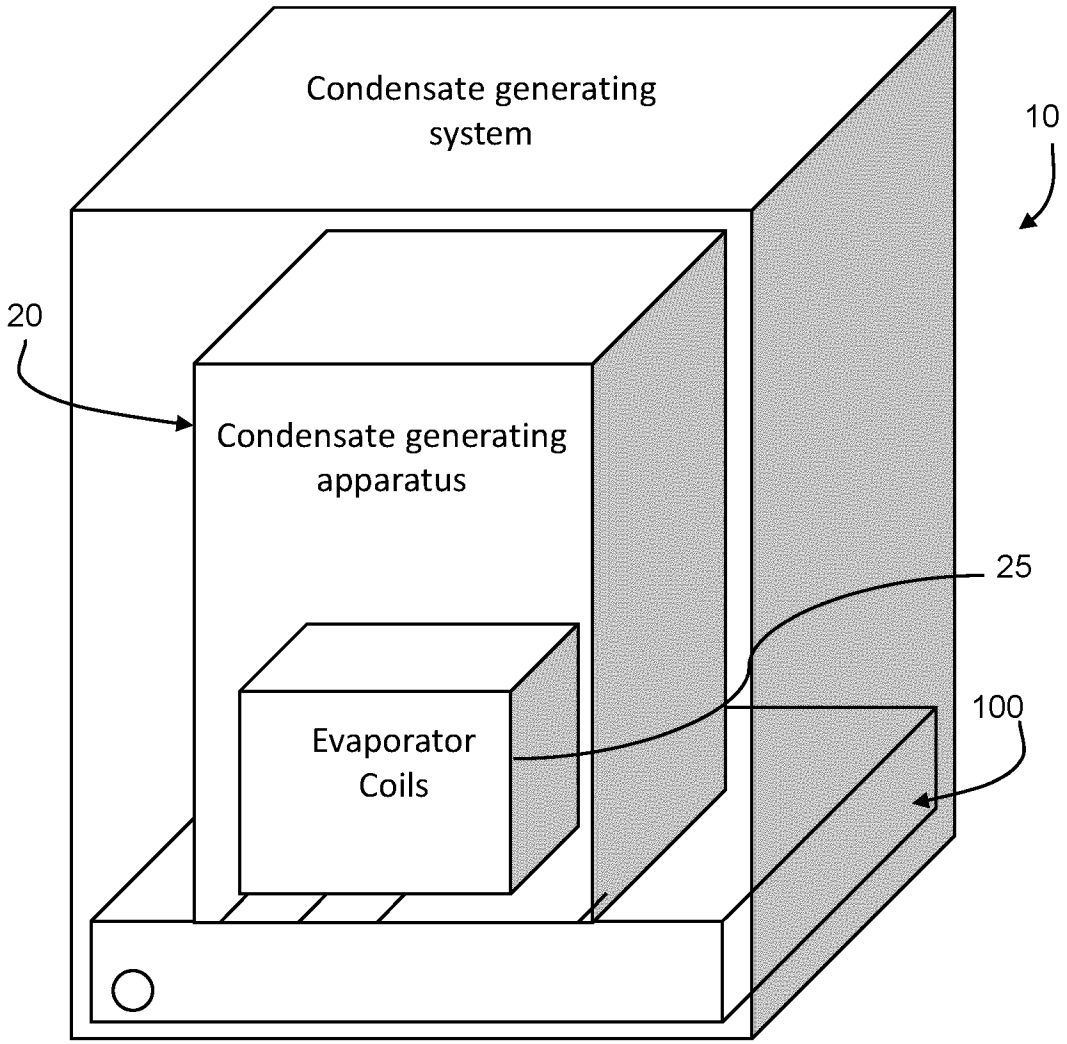
FIG. 1 is a schematic view of a drain pan system disposed within a condensate-generating system, according to an exemplary embodiment.

One embodiment of the present disclosure is a drain pan system including a drain pan. The drain pan is configured to be disposed beneath, and receive fluid from an evaporator or other component, from which condensate is generated. The drain pan system includes a well, breakwater walls located beneath the coupled evaporator, an entrainment prevention wall located between the evaporator and coils of the condenser, and a drain opening also located near the evaporator. The well accumulates condensate over time until a threshold head pressure is reached and condensate is pushed out of the drain pan. The breakwater walls may include one or more walls, each with a height corresponding to a distance between a bottom surface of the drain pan and a bottom surface of the evaporator. The entrainment prevention wall is configured to have a height corresponding to a depth of the drain pan. The entrainment prevention wall is further configured to extrude into space between two coils of the condenser. The drain pan includes an opening, configured to allow condensate to flow out of the drain pan.

In some embodiments, the system may also include an insert component configured to fit within or be coupled to the well of the drain pan and extend into the drain opening. The insert component, which is described in further detail below, may be any component that is configured to control a flow of air pulled through the drain opening, enable flow of condensate out of the drain pan system 100, and/or control condensate spray from spreading within the drain pan system 100. In various embodiments, the insert component reduces turbulence and increases smoothness of condensate flow as it exits the drain pan system. In some embodiments, the insert component is configured to generate a trap seal within a region of the drain opening, which controls the flow of condensate therethrough. In some embodiments, the insert component may be configured to keep ambient air and collected condensate separated as both pass through the drain pan well and opening.

Referring generally to the figures, a drain pan system includes a main body that includes a series of channels. The channels are configured to guide condensate from condensate generating components (e.g., an evaporator, an evaporative heat exchanger, other heating, ventilation, and air conditioning (HVAC) components, etc.) into a drain or outlet. The channels are formed by intermittent vertical walls positioned within the main body of the system, each configured to inhibit air flow that may disrupt condensate flow into and through the system. In various embodiments, a bottom surface of the drain pan system within the channels may be graded. In various embodiments, a gradation of the bottom surface may be the same, similar, or different among the channels. In various embodiments, a width of the channels may be the same or different. The channels guide condensate into a well, which is also located within the main body. The well is configured to collect condensate until sufficient head pressure has been generated by a rising level of condensate within the well. When sufficient pressure has been reached by condensate within the well, the collected condensate flows from the well out of an opening in the main body, thereby exiting the drain pan system.

In some implementations, the vertical walls include one or more breakwater walls and an entrainment prevention wall. The breakwater walls may include one or more vertical walls that each have a height equivalent to a distance between a bottom surface of the main body and a bottom surface of an evaporator positioned above the main body. In various embodiments, the breakwater walls may be integrated with the main body as a single unitary body. In other embodiments, the breakwater walls may be configured as multiple parts that are coupled to the main body.

In some implementations, the system further includes an insert component that is configured to fit within the main body in the well. The insert component is additionally configured to extend into the drain opening, facilitating smooth condensate drainage out of the system.

The drain pan system functions under negative pressure without a p-trap, which prevents potential issues typically associated with a p-trap design. The drain pan system reduces potential operational error compared to a p-trap design and is, consequently, less prone to condensate leakage due to water entrainment and/or air backflow from the drain opening. Breakwater walls within the system prevent disadvantageous air flow through the system and inhibit water entrainment. Furthermore, the herein disclosed drain pan system is less prone to clogging from contaminant accumulation as compared to equivalent systems that include a p-trap.

Referring specifically to FIG. 1, a schematic view of a drain pan system 100 positioned beneath a condensate generating apparatus 20 within a condensate generating system 10 is shown, according to an exemplary embodiment. Condensate generating system 10 may be a dehumidifier, a furnace, an air conditioner, or any other system that generates condensate. The condensate generating apparatus 20 may be a refrigeration unit, one or more heat exchangers, an evaporator, and/or a condenser. The condensate generating apparatus 20 includes evaporator 25, which is configured to generate condensate. The drain pan system 100 is configured to operate under reduced pressure conditions (e.g., below ambient pressure, etc.). The drain pan system 100 is configured to receive fluid (e.g., condensate) that is generated by an evaporator or other fluid generating component of an HVAC system and/or dehumidifier assembly. As shown in FIG. 1, drain pan system 100 may receive condensate generated by evaporator 25, which is included in condensate generating apparatus 20. For example, the drain pan system 100 may be positioned beneath, and in contact with, an evaporator within condensate generating apparatus 20 (e.g., a dehumidifier assembly, heat exchanger, etc.). In various embodiments, the drain pan system 100 may be coupled to a bottom surface of condensate generating apparatus 20 (e.g., a dehumidifier) via fasteners such as clips and/or screws. In other embodiments, the drain pan system 100 may include a sliding mechanism, similar to a drawer, allowing it to slide into a position beneath the condensate generating apparatus 20.

Figure 2:
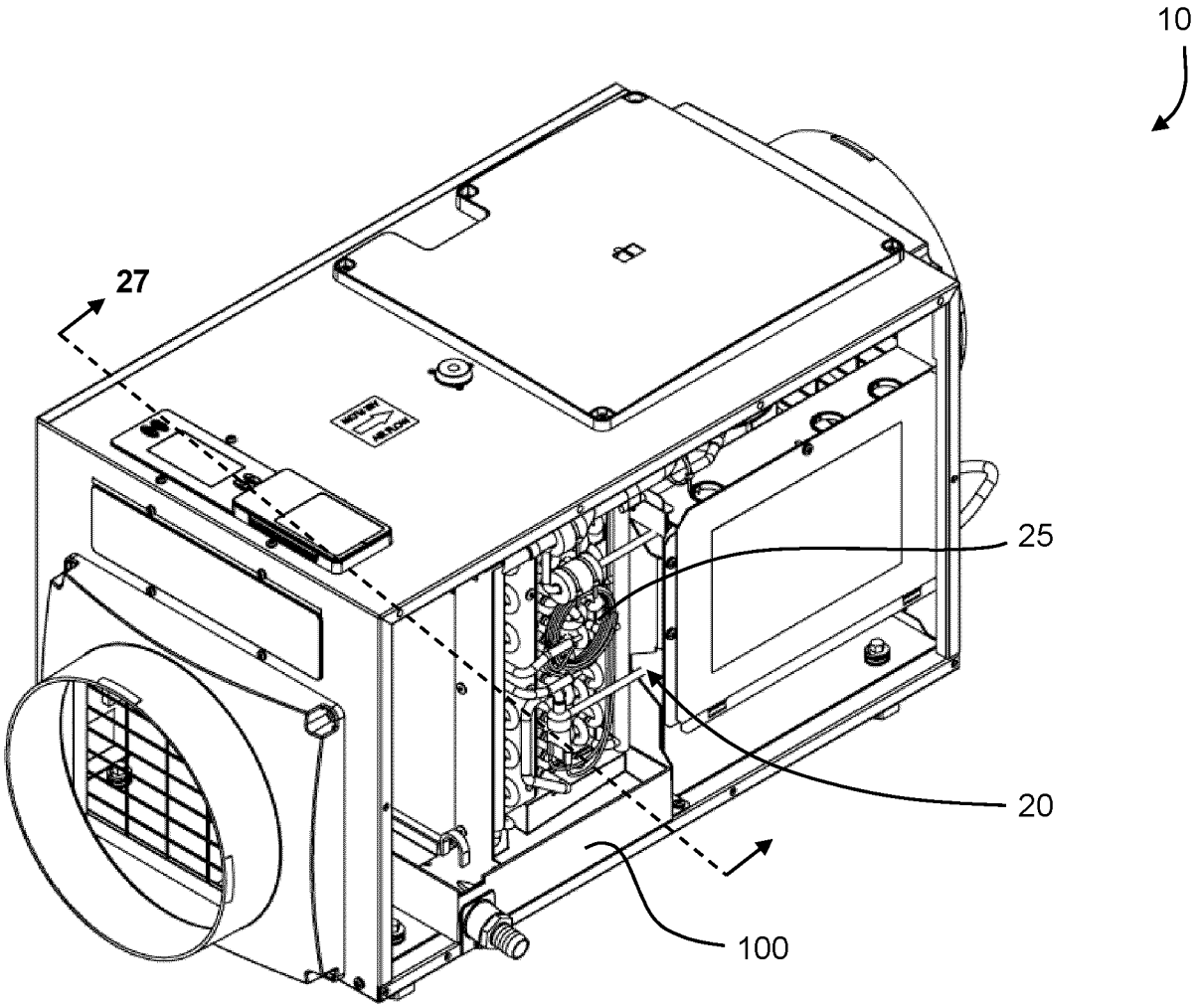
FIG. 2 is a perspective view of a drain pan system disposed within a condensate-generating system, according to an exemplary embodiment.
Figure 3:
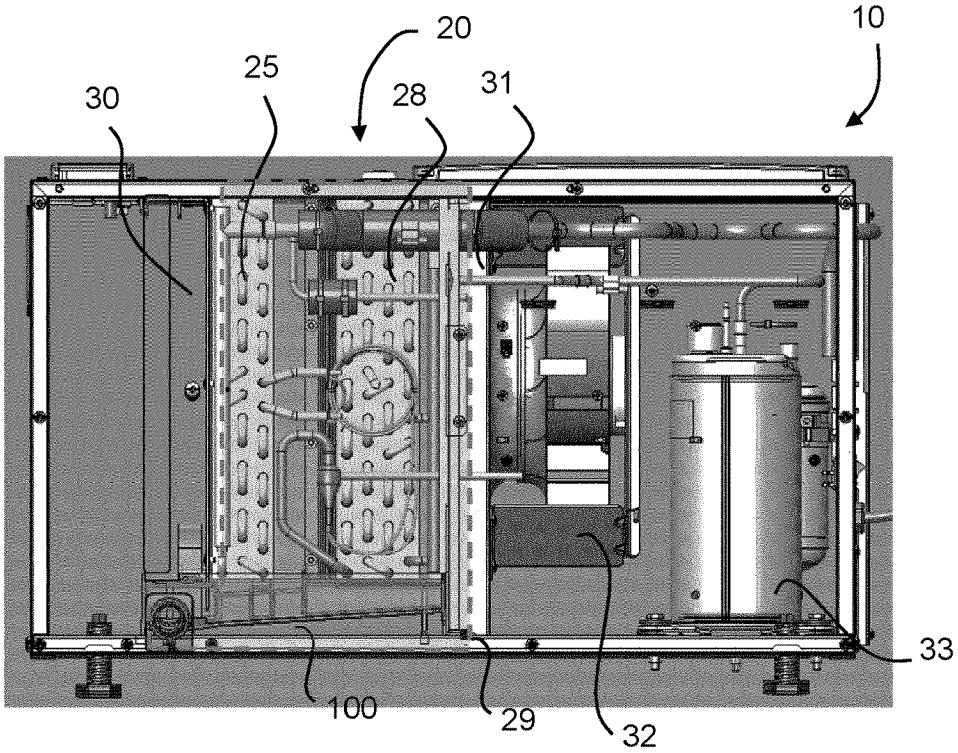
FIG. 3 is a front view of a drain pan system coupled to a condensate-generating apparatus, according to an exemplary embodiment.

FIG. 2 shows a perspective view of drain pan system 100 disposed within a condensate generating system 10, according to an exemplary embodiment. As shown, drain pan system 100 is disposed below and/or coupled to a condensate generating apparatus 20 (e.g., heat exchangers, condenser, etc.) having coils 25, which generate condensate that is received within drain pan system 100. FIG. 3 shows an end view of drain pan system 100 disposed within the condensate generating system 10, according to an exemplary embodiment. As shown, condensate generating system 10 may include a condenser 28 adjacent to evaporator 25 within condensate generating apparatus 20. In various embodiments, evaporator 25, condenser 28, and drain pan system 100 are tightly sealed within a cabinet envelope 29, which prevents turbulent air from bypassing into the drain pan system 100 and disrupting condensate flow therein.

Figure 4:
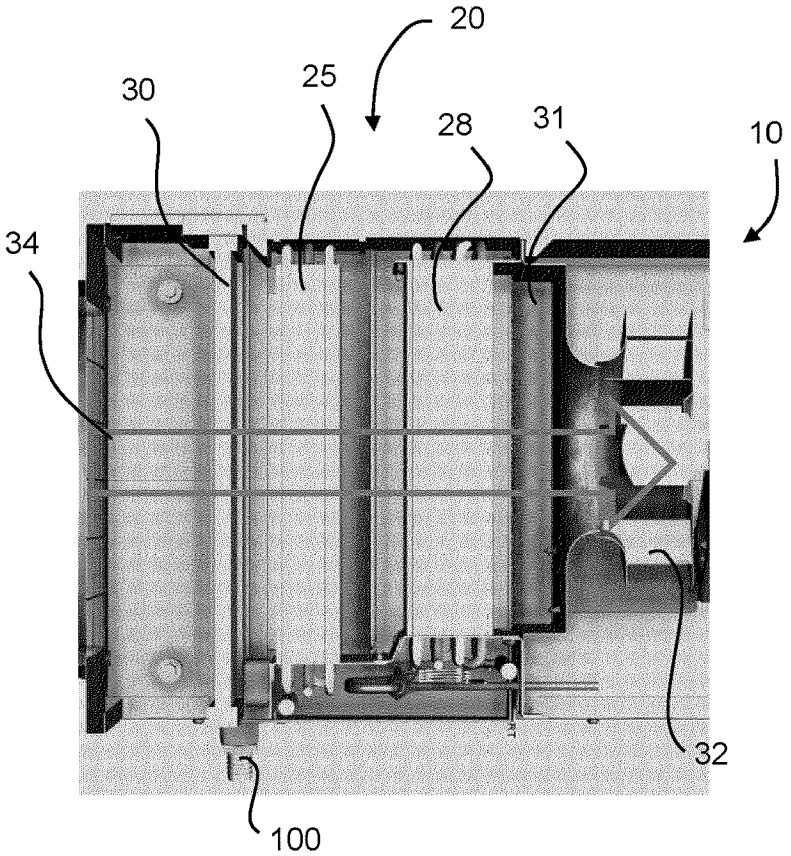
FIG. 4 is top cross-sectional view of a drain pan system disposed within a condensate-generating system, according to an exemplary embodiment.

A filter 30 may be positioned next to evaporator 25 and may be configured to filter one or more contaminants from air flowing through condensate generating system 10. In various embodiments, filter 30 may be supported by a top surface of drain pan system 100. Condensate generating system may also include a plenum box 31, which is configured to facilitate air distribution within condensate generating system 10. In various embodiments, plenum box 31 is under negative pressure. A fan 32 is positioned adjacent to the plenum box 31 and facilitates air movement through the condensate generating system 10 (e.g., for air conditioning and/or dehumidifying purpose). In various embodiments, the condensate generating system 10 is under positive pressure on a side of the plenum box 31 that includes fan 32. A compressor 33 is also included within the condensate generating system 10 and is configured to facilitate flow of a working fluid through at least one of evaporator 25 and condenser 28. Relative configurations of drain pan system 100 within condensate generating system 10 is further illustrated in FIG. 4, which shows a top cross-sectional view along line 27. As shown, condensate generating apparatus 20, which includes coils 25 is positioned above drain pan system 100 within condensate generating system 10. Airflow, as drawn by fan 32, passes through condensate generating system 10 in a direction 34.

Figure 5:
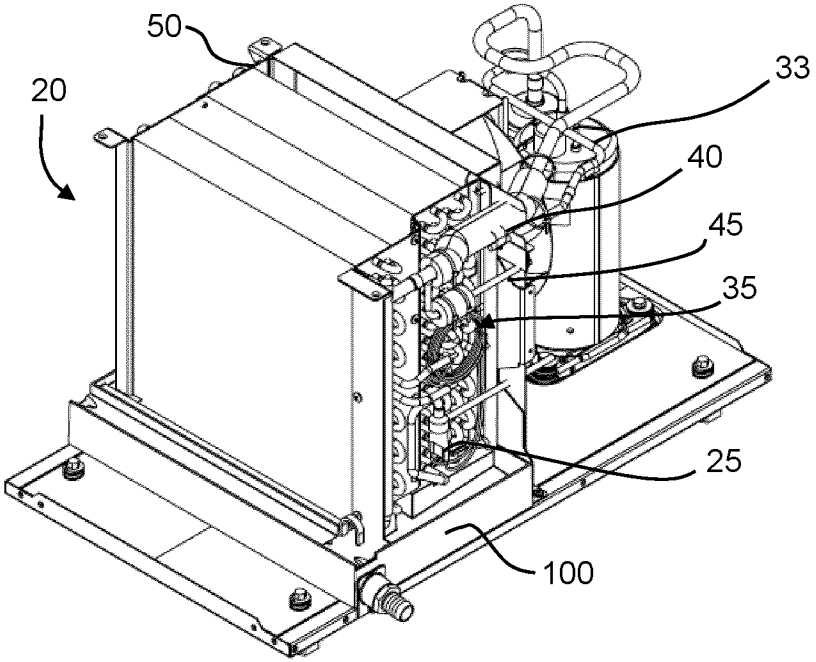
FIG. 5 is a perspective view of a drain pan system coupled to condensate-generating apparatus, according to an exemplary embodiment.
Figure 6:
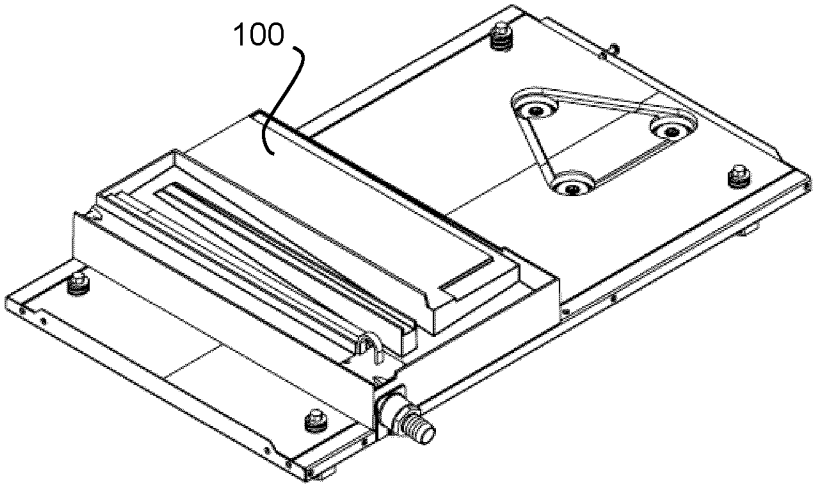
FIG. 6 is a perspective view of a drain pan system of FIG. 5, according to an exemplary embodiment.

FIGS. 5 and 6 show perspective views of drain pan system 100 positioned within condensate generating system 10, according to an exemplary embodiment. As shown in FIG.

5, drain pan system 100 is disposed below condensate generating apparatus 20. Condensate generating apparatus 20 includes coils 25, which produce a majority of condensate produced within condensate generating apparatus 20. Condensate generating apparatus also includes one or more cap tubes 35, suction lines 40, and suction process ports 45, which are each in fluid communication with a compressor 33, wherein the compressor 33 facilitates circulation of a working fluid through condensate generating apparatus 20. Condensate generating apparatus may also include a rear coil region 50 that generates condensate to be received by drain pan system 100. FIG. 6 shows drain pan system 100, which is configured to receive condensate from coils 25, cap tubes 35, suction lines 40, suction process ports 45, and rear coil region within condensate generating apparatus 20.

Figure 7:
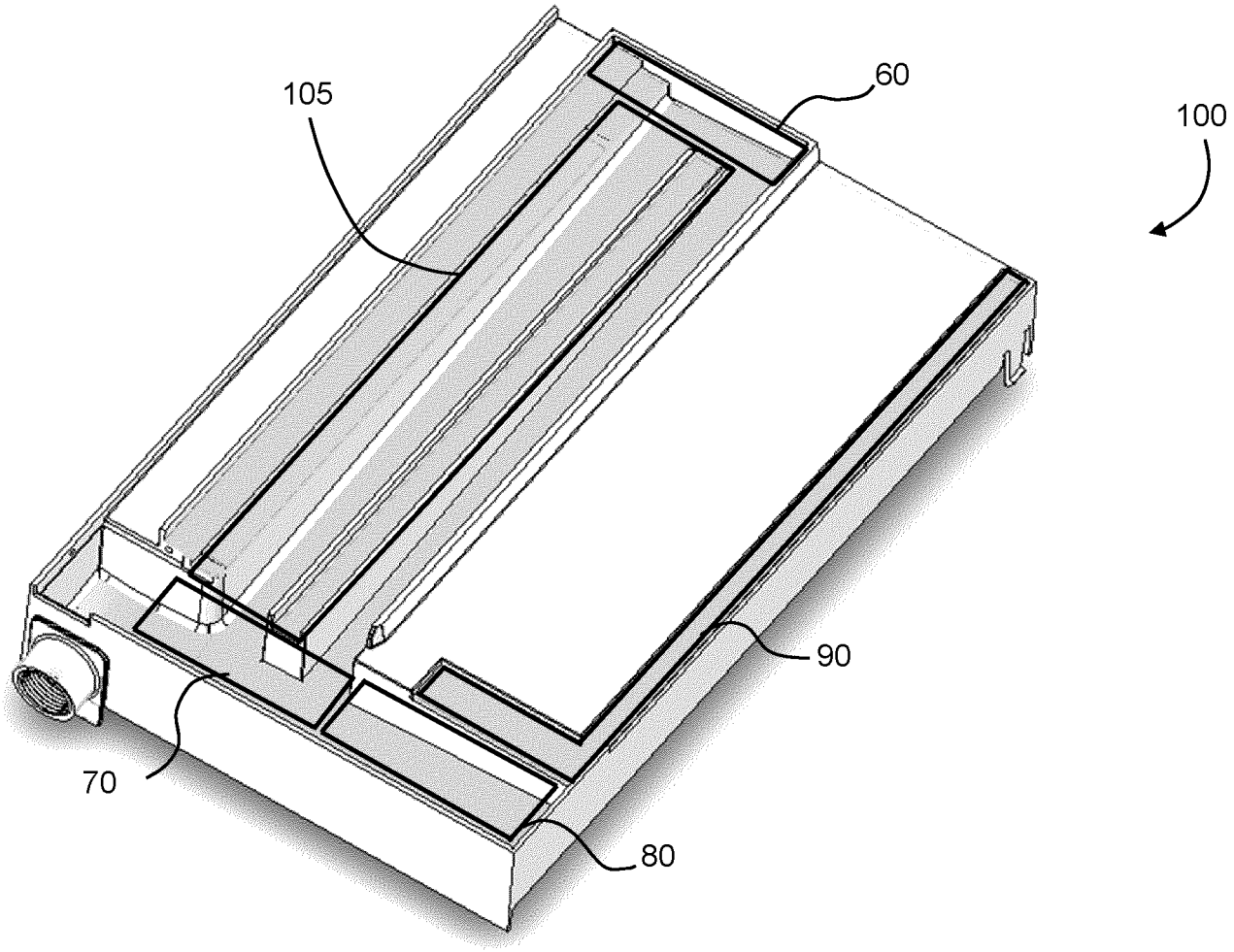
FIG. 7 is a perspective view of the drain pan system of FIG. 5, illustrating drain pan regions, according to an exemplary embodiment.

FIG. 7 shows a perspective view of drain pan system 100, according to an exemplary embodiment. As shown, drain pan system 100 includes a plurality of regions, each of which facilitates receiving condensate from condensate generating apparatus 20 when positioned below condensate generating apparatus 20. Region 60, located near a rear portion of the drain pan system 100, facilitates receiving condensate from rear coil region 50 of condensate generating apparatus 20. Similarly, regions 70 and 80, located near a front portion of the drain pan system 100 opposite region 60, receive condensate from cap tubes 35, suction lines 40, and suction ports within condensate generating apparatus 20. Region 90, located near an outer region of drain pan system 100 and extending along a length of drain pan system 100, facilitates receiving condensate from an exterior side portion of condensate generating apparatus 20. In various embodiments, region 90 receives condensate from potentially unforeseen sources within condensate generating system 20. As shown, drain pan system 100 also includes a breakwater region 105, which is located within in a substantially central portion of the drain pan system 100. Breakwater 105 facilitates receiving condensate from evaporator 25.

Figure 8:
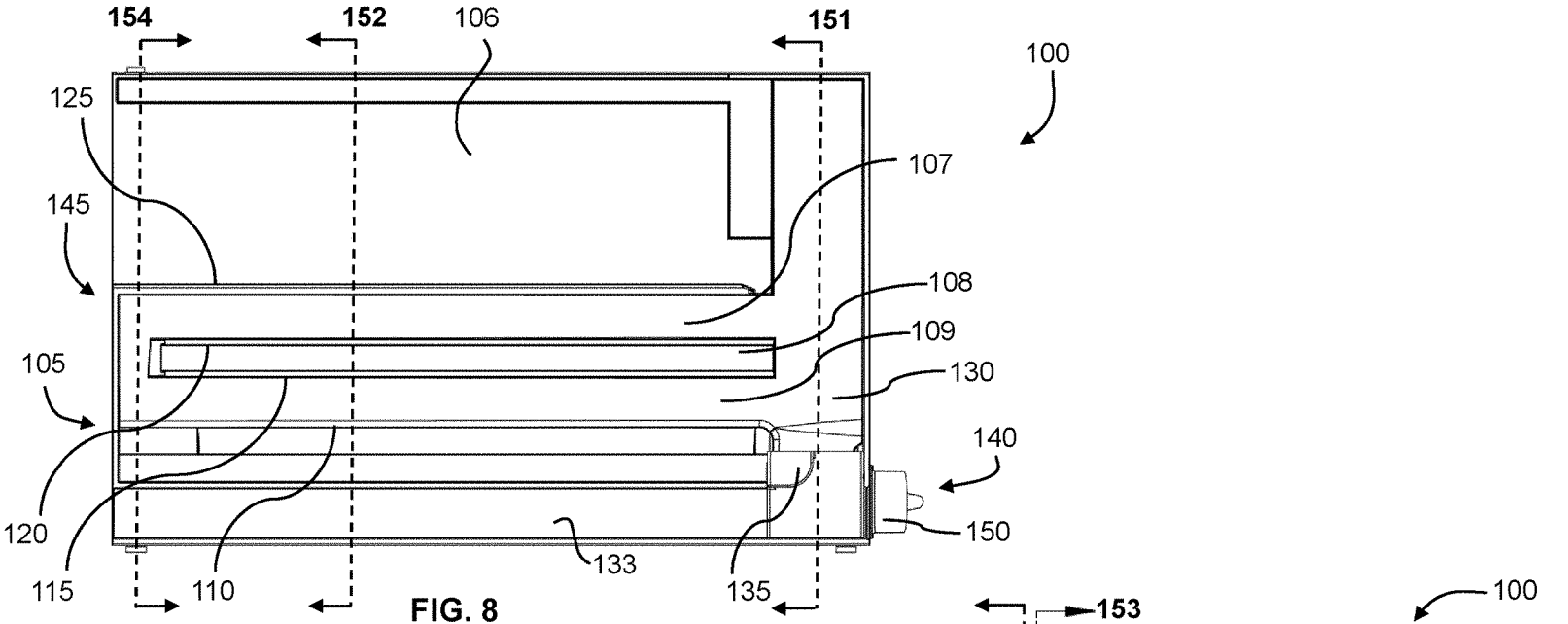
FIG. 8 is a top view of the drain pan system of FIG. 5, according to an exemplary embodiment.

In FIG. 8, a top view of a drain pan system 100 is shown in accordance with various embodiments. The drain pan system 100 includes a seat 106, which is configured to support a bottom surface of condenser 28. The drain pan system 100 includes breakwater region 105, which includes breakwater walls 110, 115, and 120. In various embodiments, the breakwater walls 110, 115, and 120 each have a height that is equivalent to a distance between a bottom surface of the drain pan system 100 and bottom surface of evaporator 25 within condensate generating apparatus 20, which is positioned above the drain pan system 100. In various embodiments, breakwater walls 110, 115, and 120 each have different heights. In other embodiments, breakwater walls 110, 115, and 120 have the same height. In various other embodiments, at least two of breakwater walls 110, 115, and 120 have the same height. In various embodiments, breakwater walls 110, 115, and 120 may be formed within drain pan system 100 via injection molding. In other embodiments, breakwater walls 110, 115, and 120 may be formed by one or more separate components fastened within drain pan system 100.

The drain pan system 100 additionally contains an entrainment prevention wall 125, which is configured to be positioned between the evaporator 25 and condenser 28, wherein condenser 28 is positioned adjacent to the evaporator 25. In various embodiments, a height of the entrainment prevention wall 125 is equivalent to a depth of the drain pan system 100 such that the entrainment prevention wall 125 extends into the space between coils of the condenser 28 and the evaporator 25. In some embodiments, entrainment prevention wall 125 is formed via injection molding. In various embodiments, a height of entrainment prevention wall 125 may be determined by an injection molding process. In other embodiments, entrainment prevention wall 125 may be formed by one or more separate components fastened within drain pan system 100.

Breakwater walls 110, 115, 120, and 125 form barriers to air passing through the drain pan system 100. The breakwater walls 110, 115, and 120 and the entrainment prevention wall 125 form channels 107, 108, and 109, which are adjacent to each wall and through which condensate may flow. The channels adjacent to walls 110, 115, 120, and 125 form pathways for condensate to flow from a shallow point 145 within the drain pan system 100 to a well 130. The well 130 forms a pathway for condensate to flow into and out of a drain opening 140, thereby enabling collected condensate to exit the drain pan system 100. The drain pan system 100 also includes a filter seat 133, located on a side of drain pan system 100 that is opposite seat 106 and which is configured to support a filter (e.g., filter 30) when disposed within condensate generating system 10. FIG. 8 additionally shows an insert component 135, which fits within the well 130 and extends into the drain opening 140.

In various embodiments, the breakwater region 105 is positioned such that each of breakwater walls 110, 115, and 120 limits air flow beneath the coupled evaporator 25, in a space between the evaporator 25 and the drain pan system 100. Each of the walls 110, 115, and 120 is configured to enable air to bypass beneath coils of evaporator 25 coupled to system 100 while also allowing condensate to flow freely into the drain pan system 100. That is, breakwater walls 110, 115, and 120 are configured to restrict air flow beneath evaporator 25 and consequently prevent interruption of condensate flow resulting from excess air flow. A height of each of the breakwater walls 110, 115, and 120 is sized to prevent condensate spray from developing as fluid flows into and through drain pan system 100. In various embodiments, breakwater wall 120 is located along a same vertical plane as a coil face of the coupled evaporator 25. This specific position of wall 120 enables condensate droplets to be transferred from a coil located near the bottom of the evaporator 25 to wall 120 via surface tension effects. Condensate that has been transferred from the evaporator to wall 120 can subsequently travel through the channels 107, 108, and 109 of drain pan system 100 for collection and eventual drainage.

In various embodiments, the entrainment prevention wall 125 is positioned between coils of the coupled evaporator 25 and condenser 28. The entrainment prevention wall 125 extends upwardly in a substantially perpendicular orientation (e.g., vertically) relative to a bottom surface of drain pan system 100 above the breakwater walls 110, 115, and 120. In various embodiments, the entrainment prevention wall 125 may have a height sufficient to break an air flow path between the coupled evaporator 25 and the drain pan system 100 and prevent entrainment. In various embodiments, the height of entrainment prevention wall 125 is equivalent to a depth of drain pan system 100. Without a barrier, such as entrainment prevention wall 125, air flow through the evaporator 25 may displace condensate from the drain pan system 100 toward the condenser 28 (e.g., water entrainment). Consequently, entrainment prevention wall 125 may extrude into a space between coils of evaporator 25, thereby interrupting air flow pathways and reducing condensate displacement.

As previously described, channels 107, 108, and 109 receive condensate via breakwater walls 110, 115, 120 and entrainment prevention wall 125. In various embodiments, each of channels 107, 108, and 109 has a sloped depth, wherein a distance from a bottom surface of each of channels 107, 108, and 109 relative to a top surface of drain pan system 100 increases with proximity to well 130. The sloping depth within channels 107, 108, and 109 utilizes both fluid surface tension and gravity to facilitate condensate flow into well 130, from which collected condensate may exit drain pan system 100 via a drain opening 140. In various embodiments, condensate is received at a shallow point 145 within drain pan system 100, where the distance from a bottom surface of each of channels 107, 108, and 109 and a top surface of drain pan system 100 is the smallest. As condensate flows toward well 130, the distance from a bottom surface of each of the channels 107, 108, and 109 to a top surface of drain pan system 100 increases. In various embodiments, the depth of each of the channels 107, 108, and 109 may be the same, different, or a combination thereof. As channels 107, 108, and 109 are formed by breakwater walls 110, 115, 120 and entrainment prevention wall 125, condensate within the channels 107, 108, and 109 may flow through drain pan system without displacement from disruptive air flow beneath the evaporator 25. In various embodiments, one or more bottom surfaces within drain pan system 100 may have a smooth finish to further facilitate flow of condensate therein.

In various embodiments, the drain opening 140 is located near the coupled evaporator 25. The drain opening 140 is fluidly coupled to well 130 such that condensate collected within well 130 flows into and out of the drain opening 140 to exit drain pan system 100. The drain pan system 100 enables condensate received from the coupled evaporator 25 and/or condenser 28 to flow through the system 100 in a direction that is opposite the direction of primary air flow beneath the evaporator 25. In addition, the drain pan opening 140 is configured to allow passage of ambient air into the drain pan system 100 ("backflow airstream") while allowing condensate from the well 130 to flow out of the system 100. The drain opening 140 receives condensate flowing away from shallow point 145 within the system 100. In various embodiments, shallow point 145 is the shallowest point within system 100, wherein the distance from a bottom surface of each of the channels 107, 108, and 109 is smallest. In various embodiments, the drain opening 140 is located as far as possible (within drain pan system 100) from the shallow point 145. In various embodiments, drain opening 140 is formed via injection molding.

FIG. 8 shows a fitting 150, which forms the drain opening. In various embodiments, fitting 150 may be a threaded fixture configured to engage with drain pan system 100. In some embodiments, fitting 150 may be a threaded barbed fitting or a threaded polyvinyl chloride (PVC) pipe adapter. In other embodiments, fitting 150 may engage with drain pan system 100 by any suitable means. In various embodiments, drain opening 140 (via drain fitting 150) may be fluidly coupled to a water hose or PVC pipe, which facilitates drainage of collected condensate away from drain pan system 100.

Figure 9:
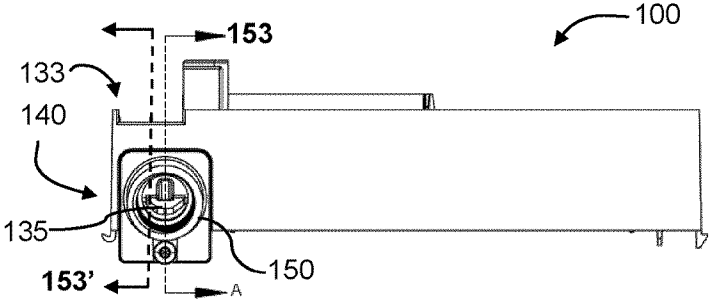
FIG. 9 is a side view of the drain pan system of FIG. 5, according to an exemplary embodiment.
Figure 10:
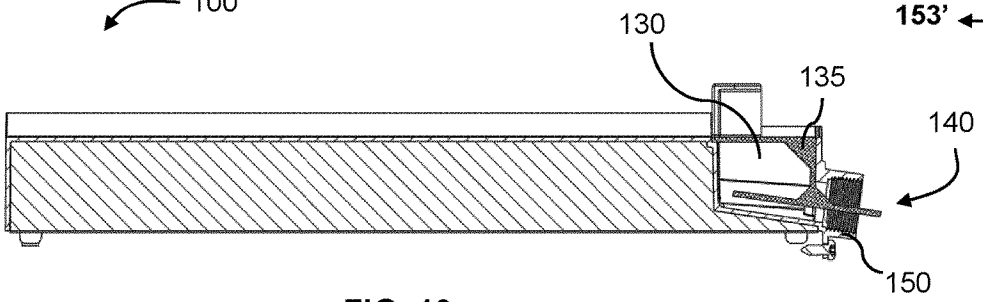
FIG. 10 is a side cross-sectional view of the drain pan system of FIG. 5, according to an exemplary embodiment.

FIG. 9 shows a side view of drain pan system 100, according to various embodiments. The insert component 135, a portion of which is visible within fitting 150 of drain opening 140, is shown to be positioned within drain pan system 100 such that it reduces an amount of air flow into drain pan system 100 through drain opening 140 and, consequently, reduces turbulence of outflowing condensate. Line 153 indicates a plane that substantially bisects drain opening 140 along a length of the drain pan system 100. FIG. 10 shows a side cross-sectional view of drain pan system 100 along line 153, according to various embodiments. As illustrated in FIG. 10, insert component 135 engages with well 130 and extends through drain opening 140 (via fitting 150) to facilitate flow of condensate out of and away from drain pan system 100.

Figure 11:
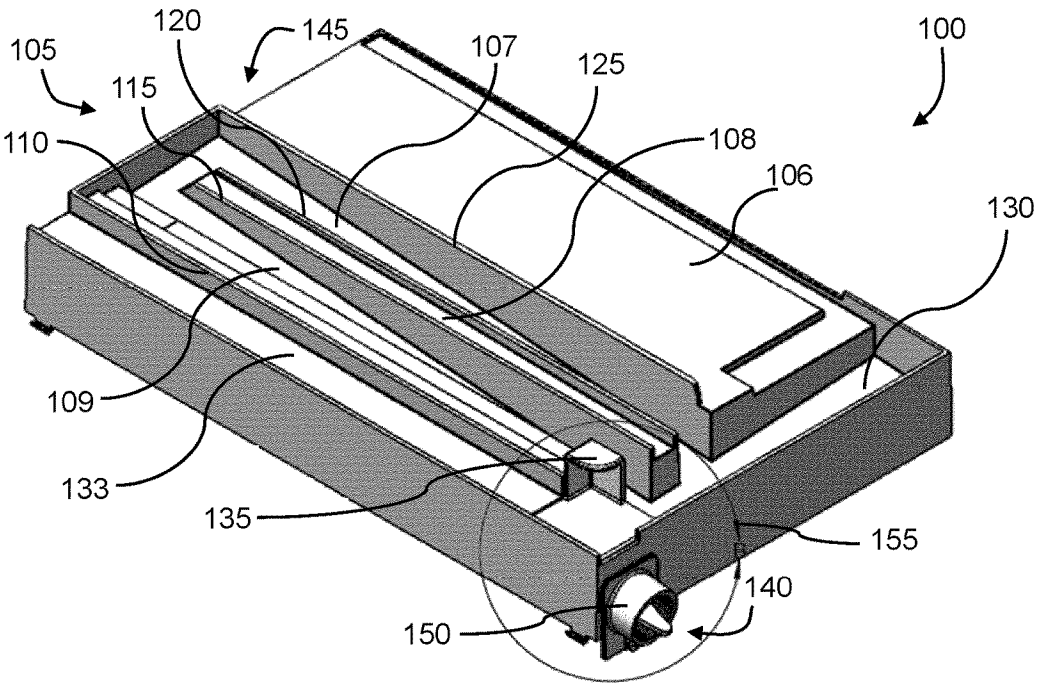
FIG. 11 is a perspective view of the drain pan system of FIG. 5, according to an exemplary embodiment.

FIG. 11 shows a perspective view of drain pan system 100, according to an exemplary embodiment. As shown in FIG. 11, drain pan system 100 includes a breakwater region 105, within which breakwater walls 110, 115, and 120 are each positioned to inhibit disadvantageous air flow (i.e., air flow that may cause turbulent condensate flow) between drain pan system 100 and coupled evaporator 25, thereby enabling condensate to flow through drain pan system 100. As shown, entrainment prevention wall 125 is positioned near breakwater region 105 and prevents disadvantageous air flow between drain pan system 100 and coupled evaporator 25 and/or condenser 28.

As illustrated in FIG. 11, channels 107, 108, and 109, which are formed between each of breakwater walls 110, 115, 120 and entrainment prevention wall 125 each have a sloped depth such that a distance between a top surface of the drain pan system and a bottom surface of each of the channels 107, 108, and 109 increases with proximity to well 130. Condensate received from channels 107, 108, and 109 may collect within well 130 and subsequently exit drain pan system 100 via fitting 150 within drain opening 140. As shown, insert component 135 engages with well 130 to enable the separate flows of condensate and air through drain opening 140.

Figure 12:
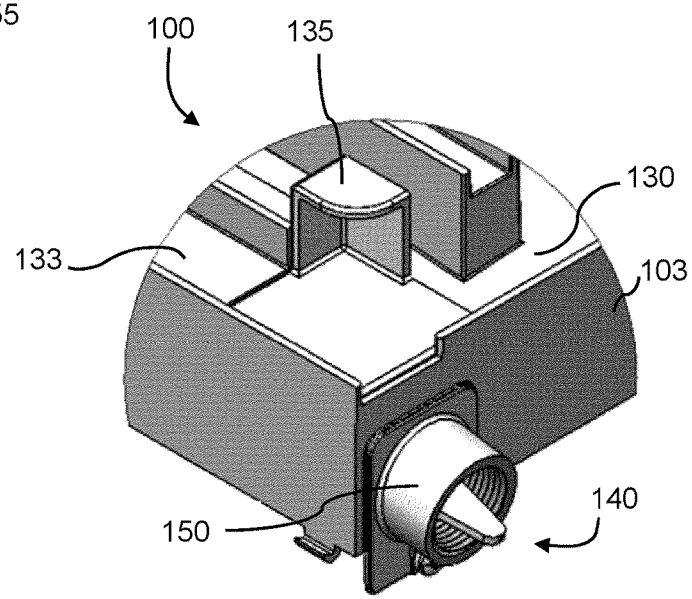
FIG. 12 is a perspective view of the drain pain system of FIG. 5 near a drain opening, according to an exemplary embodiment.

FIG. 12 shows a perspective view of drain pan system 100 near drain opening 140, according to an exemplary embodiment. FIG. 12 further illustrates the disposition of insert component 135 within drain pan system 100, wherein it engages with well 130 at a point that is maximally distant from shallow point 145. As shown, well 130 is positioned opposite the shallow point 145 and at an end of each of the channels 107, 108, and 109 such that it can receive condensate flowing therefrom. As shown in FIG. 12, a portion of insert component 135 extends through a substantially central opening within fitting 150 in drain pan opening 140.

Figure 13:
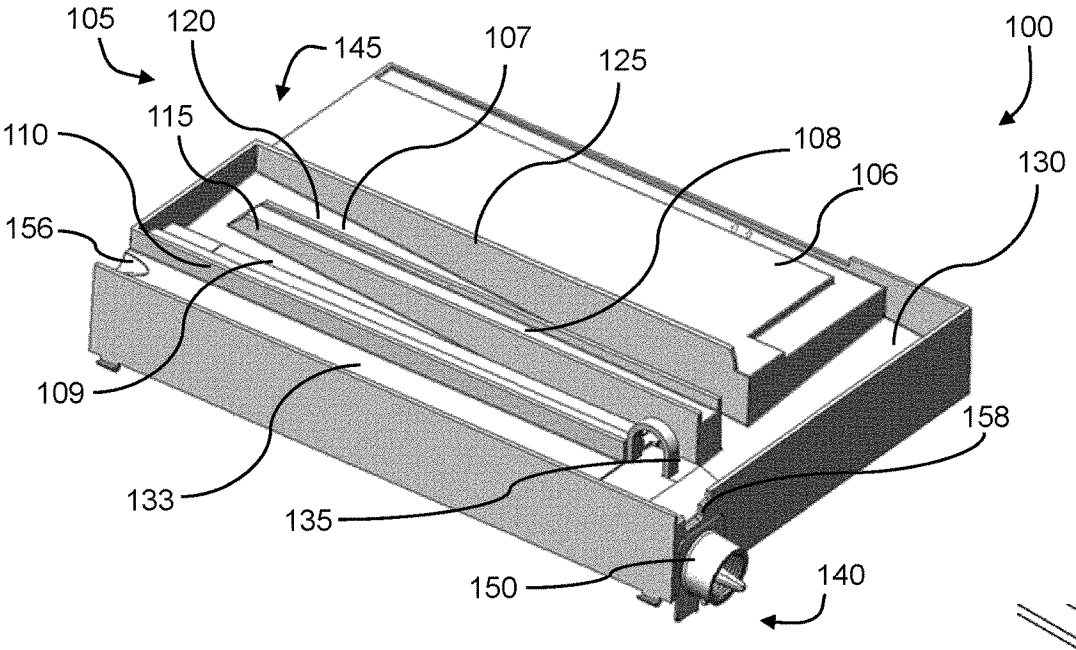
FIG. 13 a perspective view of a drain pan system, according to an exemplary embodiment.
Figure 14:
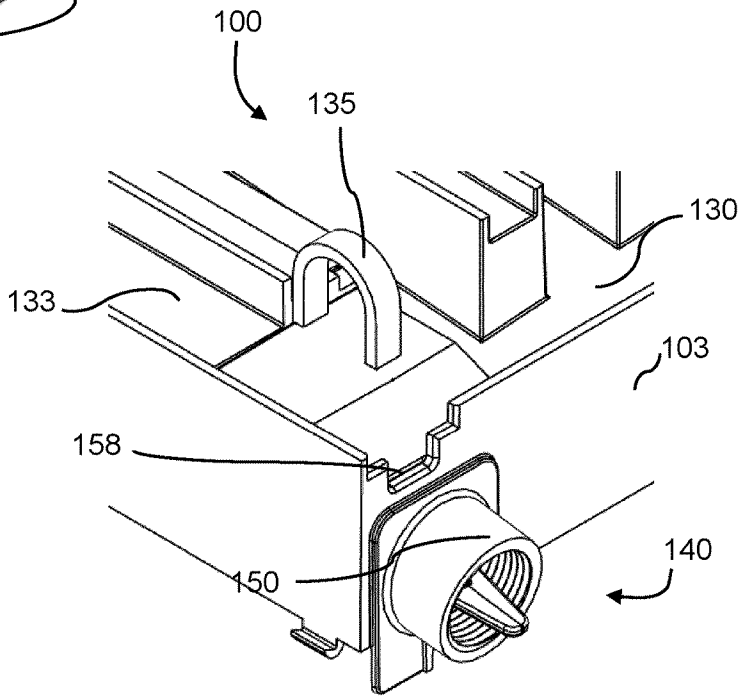
FIG. 14 is a perspective view of the drain pan system of FIG. 13 near a drain opening, according to an exemplary embodiment.

FIG. 13 shows a perspective view of drain pan system 100, according to an exemplary embodiment. In various embodiments, drain pan system 100 may include one or more features to facilitate fitting within a condensate generating system 10, including, but not limited to, features to enable ease of a filter adjacent to the drain pan system 100. As shown in FIG. 13, filter seat 133 may include a recess 156, which may enable fitting of a filter within the filter seat 133. Recess 156 facilitates compression of a spring clip of a filter upon installation of the filter 140 from a back side of the condensate generating system such that the filter may freely slide within the filter seat 133. As further illustrated in FIG. 14, drain pan system 100 may also include a cut-out portion 158 above the drain opening 140, which may be configured to receive the spring clip of the filter upon installation of the filter 140 from the front side of the condensate generating system such that the filter may slide within the filter seat 133. Such features are further discussed with respect to FIGS. 38-41.

Figure 15:
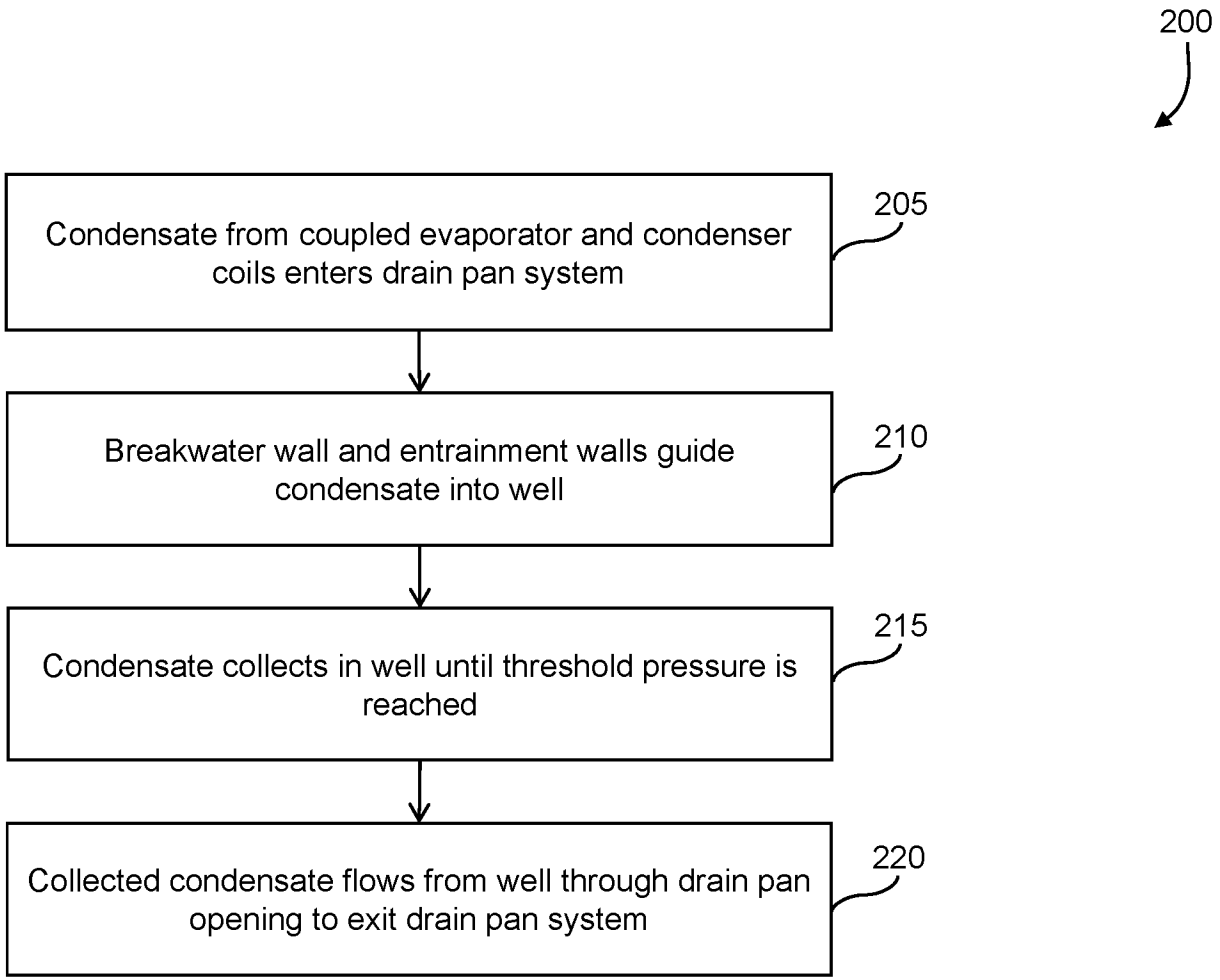
FIG. 15 is a flow diagram illustrating operations performed by the drain pan system of FIG. 5, according to an embodiment.

Drain pan system 100 facilitates collection and drainage of condensate via method 200, which is illustrated in FIG. 15 in accordance with an exemplary embodiment. In operation 205, condensate from a component (e.g., evaporator 25, condenser 28) within a condensate generating apparatus 20

(e.g., dehumidifier, HVAC system) is received within drain pan system 100. Condensate may be received within a breakwater region (e.g., regions 105, 205) via breakwater walls (e.g., 110, 115, 120), wherein condensate may flow from coils of a coupled component (e.g., evaporator) to the breakwater walls via a surface tension effect. Received condensate may subsequently flow within channels (e.g., 107, 108, 109) formed among the breakwater walls (e.g., 110, 115, 120) and an entrainment prevention wall (e.g., 125). In addition to facilitating receipt of condensate, each of the breakwater walls 110, 115, and 120 prevent disadvantageous air flow between the coupled component (e.g., evaporator 25) and the drain pan system 100, which could otherwise disrupt condensate flow within the drain pan system 100. The entrainment wall 125 provides an additional barrier for disadvantageous air flow within the drain pan system 100. In various embodiments, the drain pan system 100 may receive condensate at or near shallow point 145 and along the length of the channels 107, 108, and/or 109.

In operation 210, breakwater walls 110, 115, and 120 and/or entrainment wall 125 guide received condensate (via adjacent channels 107, 108, and 109) from shallow point 145 to well 130, which is positioned an end of the breakwater walls 110, 115, and 120 opposite the shallow point 145.

In operation 215, condensate flowing from the breakwater walls 110, 115, and 120 and the entrainment wall 125 collects within the well 130, increasing a volume of condensate and corresponding head pressure within the well. In operation 220, the condensate may flow from the well and discharge out of a drain opening 140 when the volume of condensate and corresponding head pressure within the well reaches a head pressure threshold. In various embodiments, the head pressure threshold for enabling condensate flow out of the well may be dependent on a geometry and/or configuration of the well, the drain opening, and/or any other feature within the drain pan system 100. In various embodiments, the head pressure threshold may be dependent on how drain pan system 100 is installed within condensate generating system 10. In various embodiments, the head pressure threshold may be dependent on an air-side resistance within condensate generating system 10. For example, if drain pan system 100 is installed with high air-side resistance, the head pressure threshold will be correspondingly high. In various embodiments, the head pressure and head pressure threshold may be dependent on at least one of a depth of well 130, a gradation within well 130, and a degree of slope within each of channels 107, 108, and/or 109.

Figure 16:
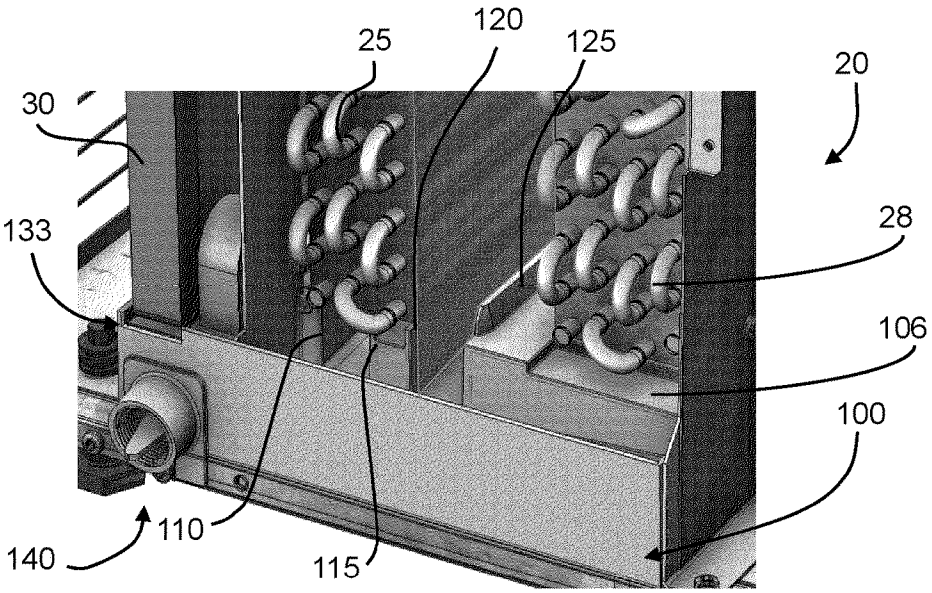
FIGS. 16-17 show perspective views of the drain pan system of FIG. 5 near an interface with the coupled condensate-generating apparatus, according to an exemplary embodiment.
Figure 17:
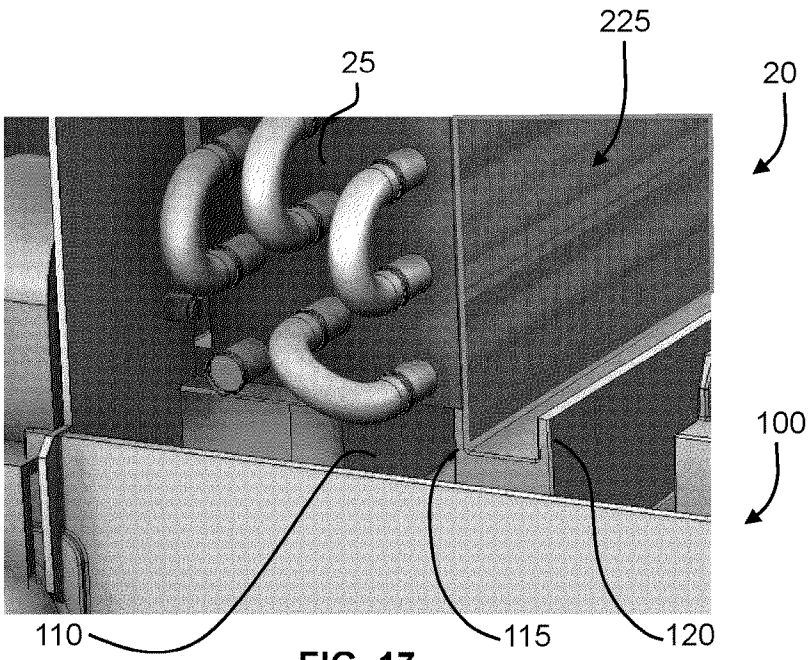

To enable condensate collection and drainage (including evaporator 25 and condenser 28) via method 200, drain pan system 100 interfaces with surfaces within condensate generating system 10 such that surface tension of the generated condensate enables transfer from a coil face (e.g., from evaporator 25 and/or condenser 28) to a surface within drain pan system 100. FIGS. 16 and 17 illustrate placement of drain pan system 100 within condensate generating apparatus 20. As shown, each of breakwater walls 110, 115, and 120 is positioned adjacent to a surface of evaporator 25 such that condensate generated by evaporator 25 can be transferred to drain pan system 100 without entrainment at an interface 225. Similarly, as shown, condenser 28 is seated within seat 106, which enables any generated condensate to be collected within drain pan system 100.

Figure 18:
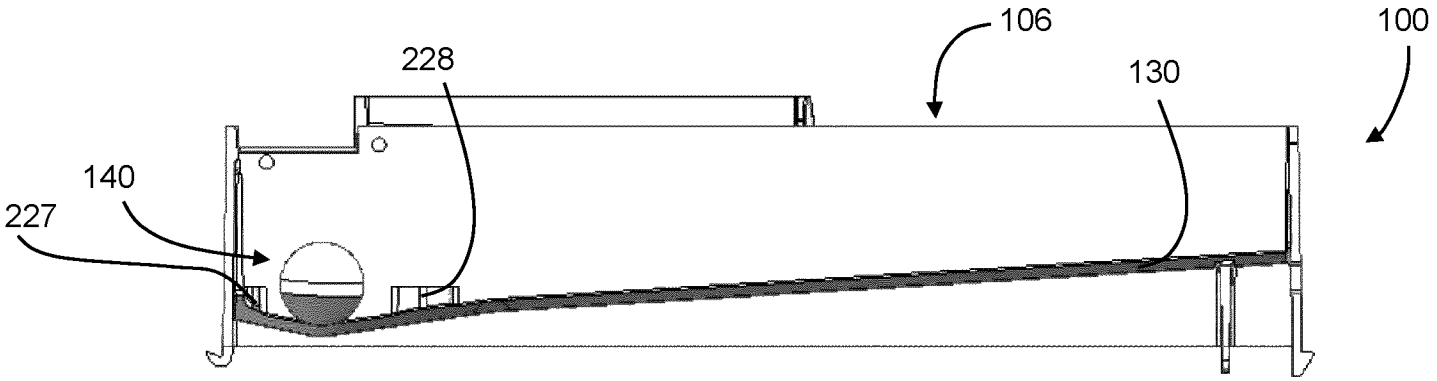
FIG. 18 shows a side cross-sectional view of the drain pan system of FIG. 5 illustrating a grade of a floor within the system, according to an exemplary embodiment.
Figure 19:
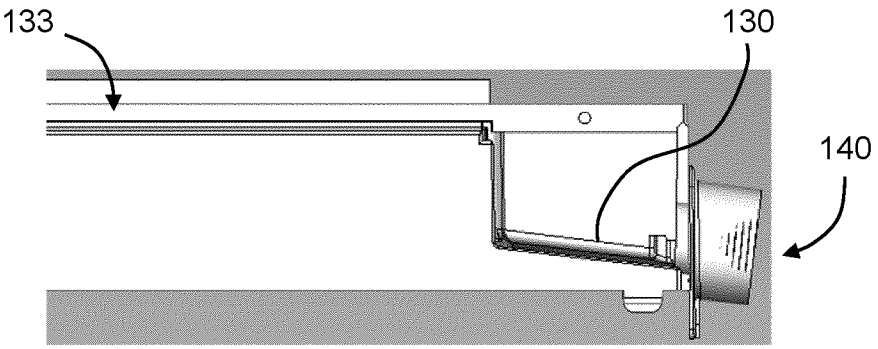
FIG. 19 is an alternate side cross-sectional view of the drain pan system of FIG. 5 near the drain opening, according to an exemplary embodiment.

As previously mentioned, in various embodiments, flow of condensate within drain pan system 100 may be dependent on a slope and/or gradation of one or more bottom surfaces within drain pan system 100. FIG. 18 shows a side cross-sectional view of drain pan system 100 taken along line 151, according to an exemplary embodiment. As shown, well 130 is configured to have a slope such that a distance between a bottom surface of well 130 and a top surface of drain pan system 100 increases with proximity to drain opening 140 in a direction perpendicular to each of breakwater walls 110, 115, and 120. As shown in FIG. 19, well 130 may also have a slope in a direction parallel to each of breakwater walls 110, 115, and 120. In various embodiments, a distance between a bottom surface of well 130 and a top surface of drain pan system 100 is largest at the drain opening 140. In various embodiments, drain pan system 100 may include drain pan insert shelves 227 and 228, as shown in FIG. 18, which may facilitate controlling a position of insert component 135 to, consequently, further enable drainage through drain opening 140.

Figure 20:
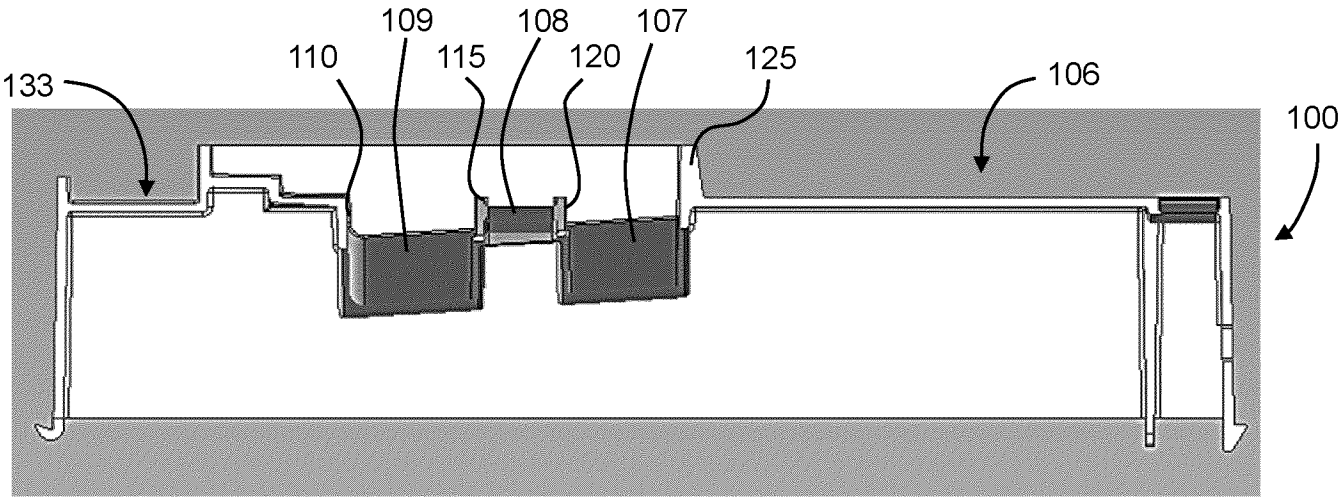
FIG. 20 is a side cross-sectional view of the drain pan system of FIG. 5 illustrating grades of channels within the system, according to an exemplary embodiment.
Figure 21:
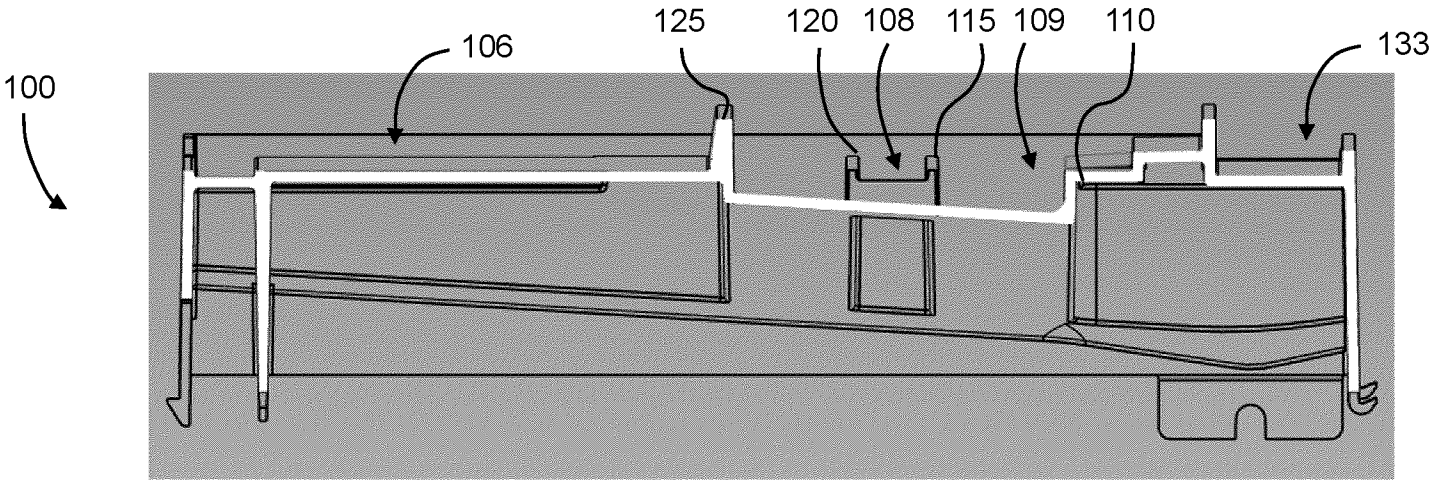
FIG. 21 is a side cross-sectional view of the drain pan system of FIG. 5 illustrating grades of condensate-receiving surfaces within the system, according to an exemplary embodiment.

Similar to well 130, each of channels 107, 108, and 109, which are disposed within a top surface of drain pan system 100, include a sloped or graded bottom surface therethrough. FIGS. 20 and 21 show cross-sectional views of drain pan system taken along lines 152 and 154, respectively. As shown, a bottom surface within each of channels 107, 108, and 109 is sloped such that a distance between the bottom surface and a top surface of drain pan system 100 increases with proximity to filter seat 133 (which is adjacent to drain opening 140). In various embodiments, a gradation of the bottom surface within each of channels 107, 108, and 109 may be the same. In various embodiments, the gradation of the bottom surface within each of channels 107, 108, and 109 may be different. In various embodiments, at least two of the gradations of the bottom surfaces channels 107, 108, and 109 may be the same.

In various embodiments, collection and flow of condensate within drain pan system 100 may be dependent on a position of drain pan system 100 below condensate generating apparatus 20.

Figure 22:
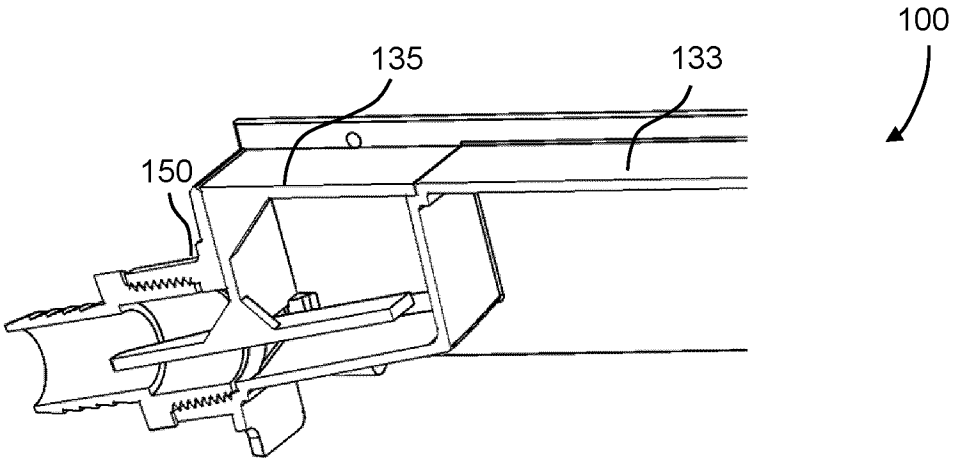
FIG. 22 is a perspective cross-sectional view of the drain pan system of FIG. 5 near the drain opening, according to an exemplary embodiment.

As described previously, condensate flow out of drain pan system 100 via drain opening 140 is facilitated by insert component 135, which is disposed within and/or coupled to well 130. FIG. 22 shows a cross-sectional view of drain pan system 100 taken along line 153' near drain opening 140, according to an exemplary embodiment. As shown, insert component 135 is disposed within well 130 and extends through drain opening 140. In various embodiments, a top surface of insert component 135 is also configured to be adjacent to and flush with filter channel 130, as shown. Insert component 135 reduces turbulence in outflowing condensate by reducing a flow of air through the drain opening 140.

Figure 23:
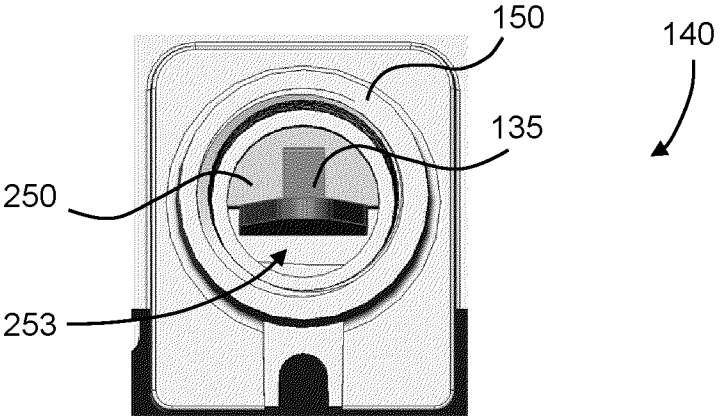
FIG. 23 is an end view of the drain opening of the drain pan system of FIG. 5, according to an exemplary embodiment.
Figure 24:
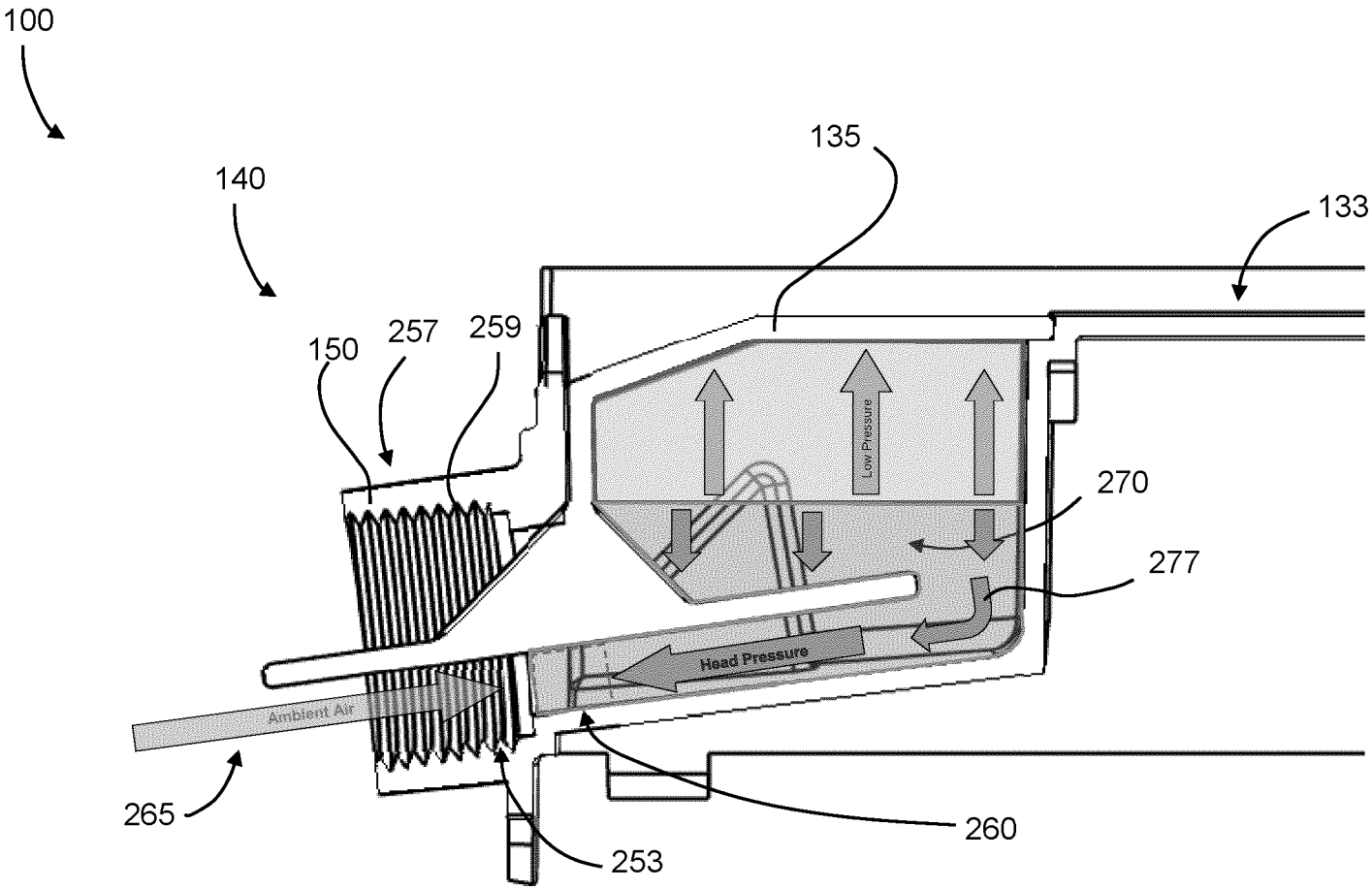
FIG. 24 is a schematic view of air and head pressure within the drain opening of the drain pan system of FIG. 5, according to an exemplary embodiment.

FIG. 23 shows an end view of drain opening 140, according to an exemplary embodiment. As shown, insert component 135 include a vertical portion 250, which restricts flow through drain opening 140 to a smaller flow region 253. FIG. 24 shows a schematic side cross-sectional view of drain pan system 100 near drain opening 140, according to an exemplary embodiment. As shown in FIG. 24, insert component 135 extends into both well 130 and drain opening 140. Drain opening 140 is formed by fitting 150, which is coupled to drain pan system 100 at coupling 257 via threads 259. During operation, condensate will collect in well 130. Air pressure 265, which corresponds to an ambient pressure within drain pan system 100, prevents condensate drainage out of drain opening 140 by forming a trap seal 260 within flow region 253. In various embodiments, the trap seal 260 is formed if the pressure 265 is greater than a head pressure 270 generated by collected condensate within well 130. In various embodiments, once the head pressure 270 exceeds the air pressure 265, condensate may flow out of drain opening 140 in a direction 277 via flow region 253. In various embodiments, head pressure 270 may exceed air pressure 265 when a level of the collected amount of condensate within well 130 exceeds a bottom surface of insert component 135. In various embodiments, insert component 135 facilitates generation of the trap seal 260 and, consequently, facilitates controlled outflow of condensate from drain pan system 100.

Figure 25:
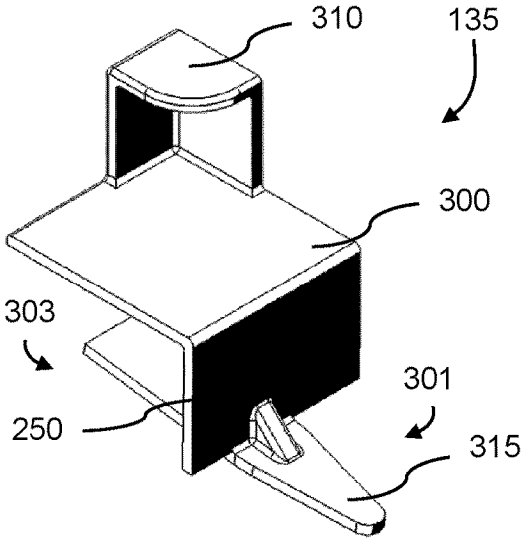
FIG. 25 is a perspective view of an insert component configured to fit within the drain pan system of FIG. 5, according to an exemplary embodiment.

FIG. 25 shows a perspective view of insert component 135, according to various embodiments. As shown, the insert component 135 is coupled between drain 130 and drain opening 140, according to various embodiments. In various embodiments, system 100 may or may not include insert component 135. In some embodiments, insert component 135 may be included as an add-on and/or removable component within system 100. The insert component 135 facilitates the reduction of turbulence that may arise from condensate flowing out of drain pan system 100 (via well 130 and drain opening 140) and ambient air drawn into the drain pan system 100 (via drain opening 140). Air turbulence through the drain opening 140 may prevent condensate from flowing smoothly out of drain opening 140. The condensate is directed toward the drain opening 140 by the insert component 135 via surface tension to flow along the insert component 135 geometry and discharge smoothly from the drain opening 140. In various embodiments, insert component 135 extends through fitting 150 of drain opening 140 and protrudes beyond the end of the fitting 150.

As shown in FIG. 25, insert component 135 includes a substantially horizontal portion 300, which is positioned a distance above a bottom surface of well 130. In various embodiments, horizontal portion 300 is flush with a top surface of filter seat 133. In various embodiments, horizontal portion 300 forms a section of the filter seat 133, wherein filter 30 is supported by horizontal portion 300. Insert component 135 also includes substantially vertical portion 250, which is connected to horizontal portion 300 along an upper edge and is substantially parallel to a side of drain pan system 100. In various embodiments, vertical portion 250 may be in contact with a side wall of drain pan system 100 (e.g., a side wall defining well 130) or located a distance from a side wall of main body 103. A handle 310 is connected to horizontal portion 300 near a distal edge opposite the upper edge connecting to vertical portion 305. Handle 310 facilitates placement and/or removal of the insert component 135. In various embodiments, handle 310 may be a tab, a ring, or any other protruding feature, which may facilitate placement and/or removal of the insert component 135. Vertical portion 250 is connected to a slanted portion 315 at an intermediate position between first and second ends 301 and 303. Slanted portion 315 enables generation of the trap seal 260 and, consequently, facilitates controlled outflow of condensate from drain pan system 100. In various embodiments, slanted portion 315 facilitates separation of air from condensate to prevent turbulence. Slanted portion 315 is positioned such that the first end 301 is configured to extend through drain opening 140 and the second end 303 is configured to extend into well 130. In various embodiments, the first end 301 of slanted portion 315 may have a width that decreases with increasing distance from vertical portion 250.

Figure 26:
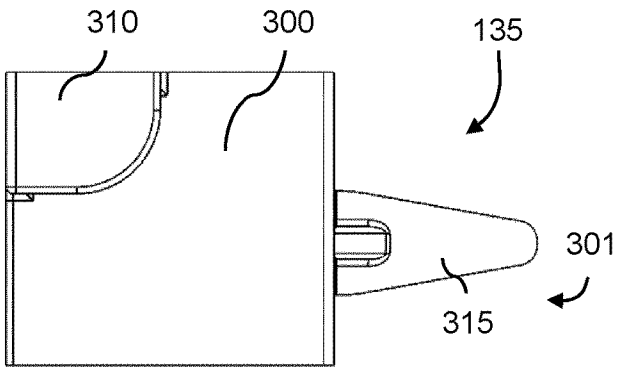
FIG. 26 is a top view of the insert component of FIG. 23, according to an exemplary embodiment.

FIG. 26 shows a top view of insert component 135, according to various embodiments. As shown in FIG. 26, handle 310 is coupled with horizontal portion 300 near a distal edge opposite the upper edge connecting to vertical portion 305. Vertical portion 250 is further coupled to slanted portion 315 at a lower edge opposite the upper edge connecting to horizontal portion 300. As shown in FIG. 26, first end 301 of slanted portion 315 extends toward and through drain opening 140.

Figure 28:
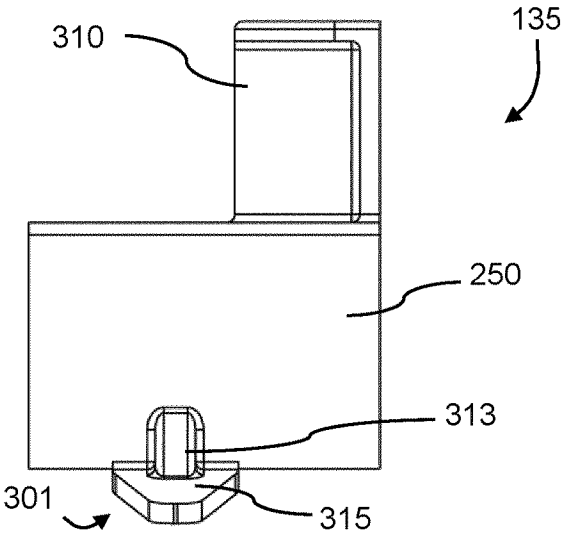
FIG. 28 is a side view of the insert component of FIG. 25, according to an exemplary embodiment.
Figure 27:
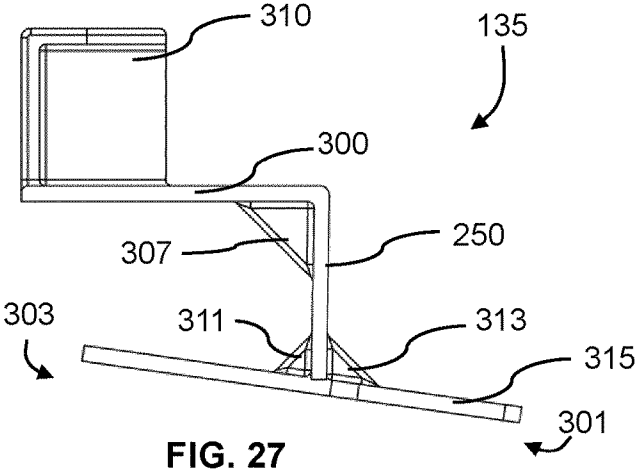
FIG. 27 is a side view of the insert component of FIG. 25, according to an exemplary embodiment.
Figure 30:
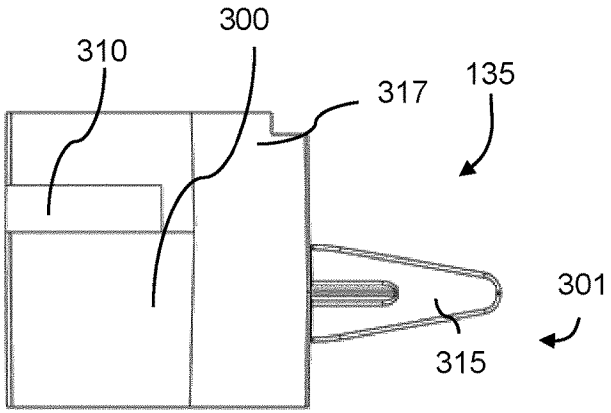
FIG. 30 is a top view of the insert component of FIG. 29, according to an exemplary embodiment.
Figure 32:
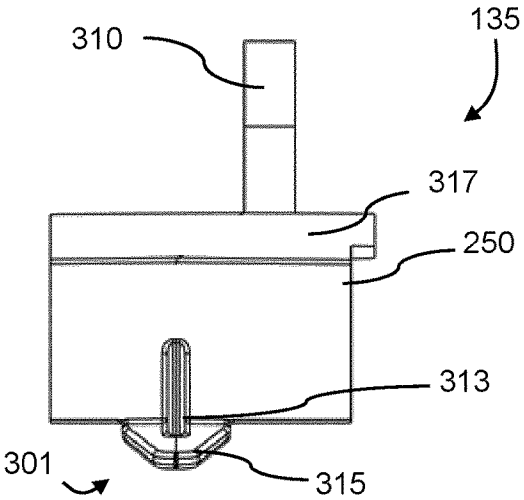
FIG. 32 shows a side view of the insert component of FIG. 29, according to an exemplary embodiment.
Figure 29:
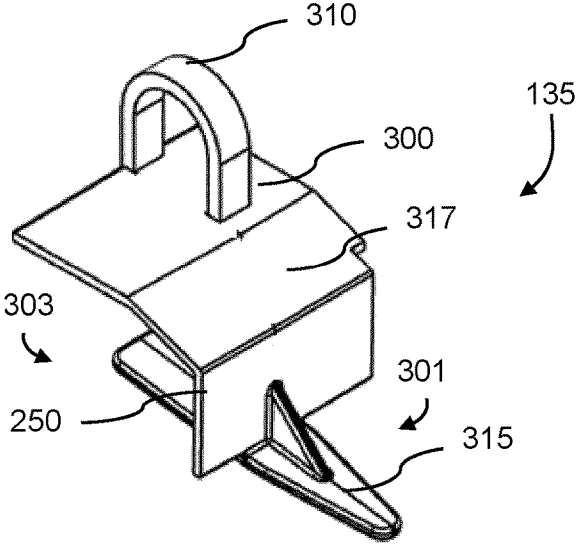
FIG. 29 is a perspective view of an insert component configured to fit within a drain pan system, according to an exemplary embodiment.
Figure 31:
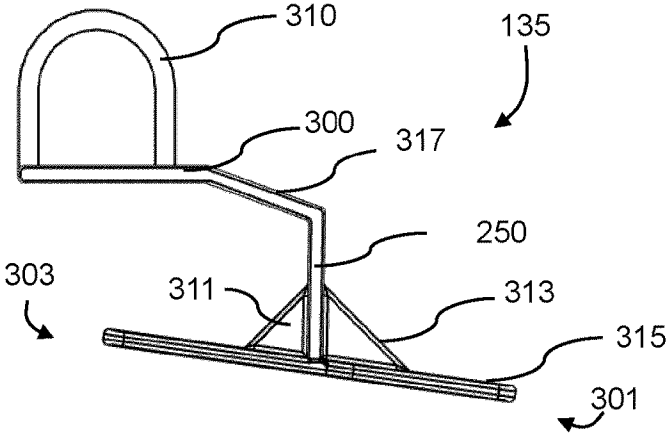
FIG. 31 is a side view of the insert component of FIG. 29, according to an exemplary embodiment.

FIG. 27 shows a side view of insert component 135, according to various embodiments. FIG. 27 further illustrates the dispositions of horizontal portion 300 and vertical portion 250 as coupled to handle 310 and slanted portion 315, respectively. As shown in FIG. 27, slanted portion 315 is coupled to vertical portion 250 at an oblique angle relative to horizontal portion 300, such that the first end 301 is located at a vertical distance below the second end 303 to guide condensate out of drain pan system 100. Horizontal portion 300 and vertical portion 250 are coupled to support portion 307 (e.g., support ribs), which maintains a configuration of horizontal portion 300 relative to vertical portion 250 and vice versa. Similarly, support portions 311 and 313 maintain a configuration of slanted portion 315 relative to vertical portion 250 and vice versa. FIG. 28, which shows an alternate side view of insert component 135 according to various embodiments, further illustrates the relative configurations among handle 310, vertical portion 250, and slanted portion 315.

In various embodiments, insert component 135 may be configured to reduce condensate turbulence during a self-priming phase, occurring after installation of drain pan system 100. During self-priming, as air pulls through drain opening 140 and condensate collects in well 130, turbulence and/or condensate spray may be generated. Slanted portion 315, in addition to vertical portion 250 and horizontal portion 300, form an enclosure surrounding drain opening 140 to contain condensate within the well 130. Accordingly, insert component 135, via slanted portion 315, vertical portion 250, and horizontal portion 300, prevent or reduce condensate spray outside of well 130 and facilitate smooth flow of condensate out of drain opening 140 through flow region 253.

FIGS. 29-32 show another design for insert component 135, according to another exemplary embodiment. The insert component 135 shown in FIGS. 29-32 may be substituted for any other embodiments of the insert component 135 throughout this specification. As shown, the insert component 135 of FIGS. 29-32 includes handle 310, which may have at least partial ring-shape or curved portion to facilitate easier gripping. Alternatively, or in addition, insert component 135 may include an angled portion 317, which is connected between the horizontal portion 300 and the vertical portion 250, as shown in FIGS. 29-32. In various embodiments, angled portion 317 may enable ease of filter installation above the drain pan system 100 (e.g., within filter seat 133) and/or facilitate placement and fitting of the drain pan system 100 adjacent to one or more condensate generating components.

Figure 33:
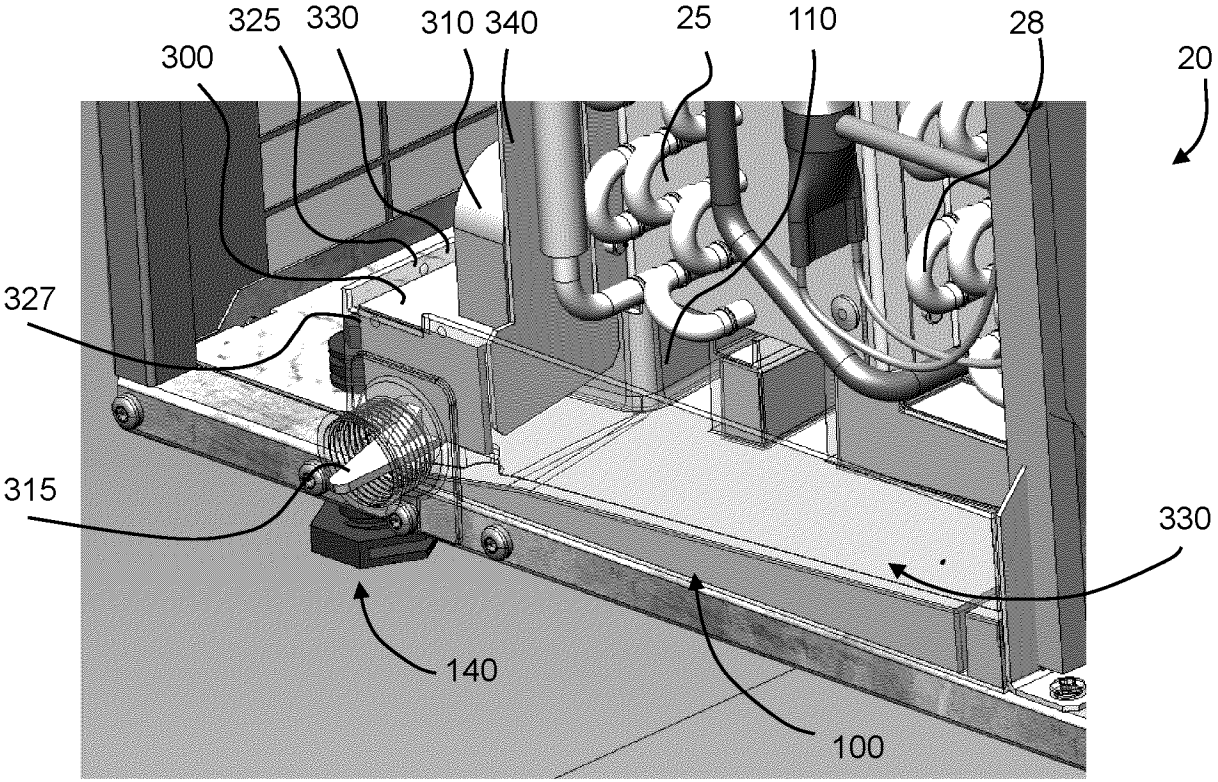
FIG. 33 is a perspective view of a drain pan system of FIG. 5 near the drain opening, according to an exemplary embodiment.

Similar to insert component 135, which reduces risk of condensate spray outside of well 130, drain pan system 100 may prevent condensate spray outside of the drain pan system 100. FIG. 33 shows a perspective view of drain pan system 100 disposed below condensate generating apparatus 20, according to an exemplary embodiment. As shown, drain pan system 100 is positioned below condenser 28 and evaporator 25. Drain pan system 100 may include one or more attachment points 325 and 327, which facilitate attachment of the drain pan system 100 within the condensate generating system 10 via friction fit. In various embodiments, when drain pan system 100 is placed and attached below evaporator 25 and condenser 28 in condensate generating system 10, walls 330, insert component 135, and evaporator 25 coil header 340 form barriers surrounding well 130 and drain opening 140. Accordingly, walls 330, insert component 135, and coil header 340 prevent condensate within well 130 and/or drain opening 140 from spraying outside drain pan system 100.

Figure 35:
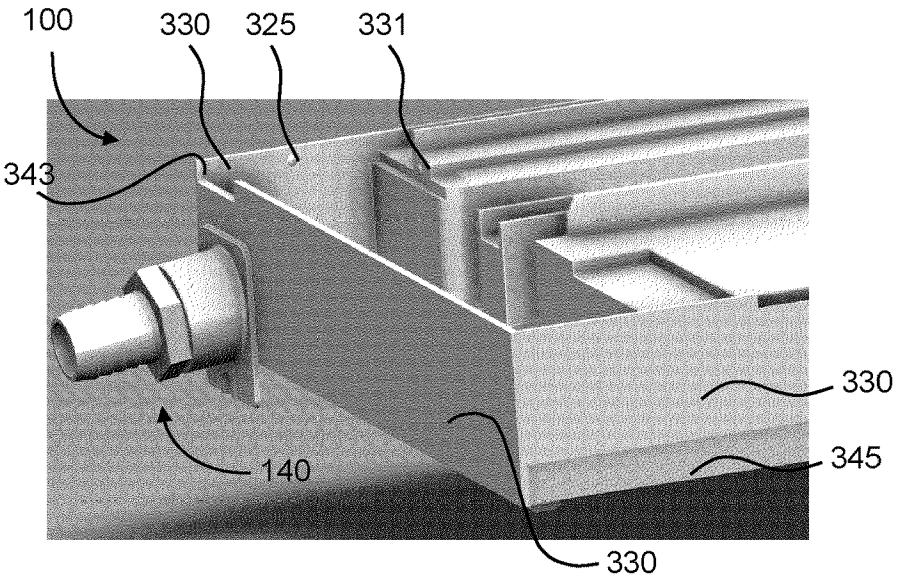
FIG. 35 is an alternative perspective view of the drain pan system of FIG. 5 near the drain opening, according to an exemplary embodiment.
Figure 34:
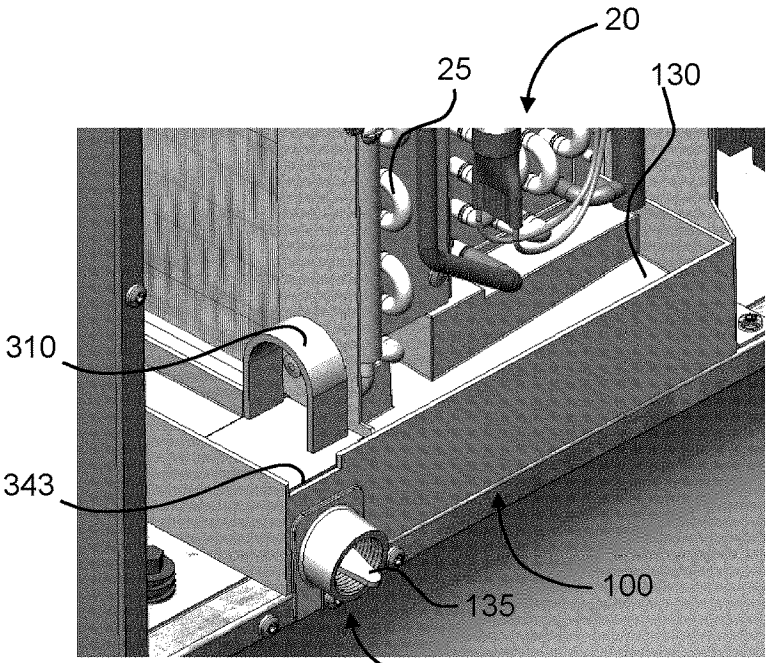
FIG. 34 is an alternate perspective view of the drain pan system of FIG. 5 near the drain opening, according to an exemplary embodiment.

FIGS. 34 and 35 show perspective views of drain pan system 100 near drain opening 140, according to exemplary embodiments. As shown in FIG. 34, handle 310 of insert component 135 may be readily accessible within drain pan system 100. In various embodiments, handle 310 may facilitate placement and removal of insert component 135. In various embodiments, handle 310 may be configured to attach or latch to one or more attachment points on or within condensate generating apparatus 20. As previously described, drain pan system 100 may also include attachment points 325 and 327 to facilitate attachment of the drain pan system 100 to condensate generating apparatus 20. As shown in FIG. 35, drain pan system 100 may also include an attachment point 331, which may facilitate attachment of drain pan system 100 to condensate generating apparatus 20 via friction fit. In various embodiments, drain pan system 100 may include any number of attachment points. In some embodiments, drain pan system 100 includes a plurality of attachment points along a length of each of walls 330. In various embodiments, drain pan system 100 includes one or more attachment points along a top surface of drain pan system 100 near one or more interfaces with condensate generating apparatus 20 (e.g., near an interface with evaporator 25 and/or condenser 28).

As shown in FIG. 35, drain pan system 100 may also include an insulation panel 345, which may be affixed to a bottom surface of the drain pan system 100 to prevent formation of condensation along or within the bottom surface of the drain pan system 100.

Figure 36:
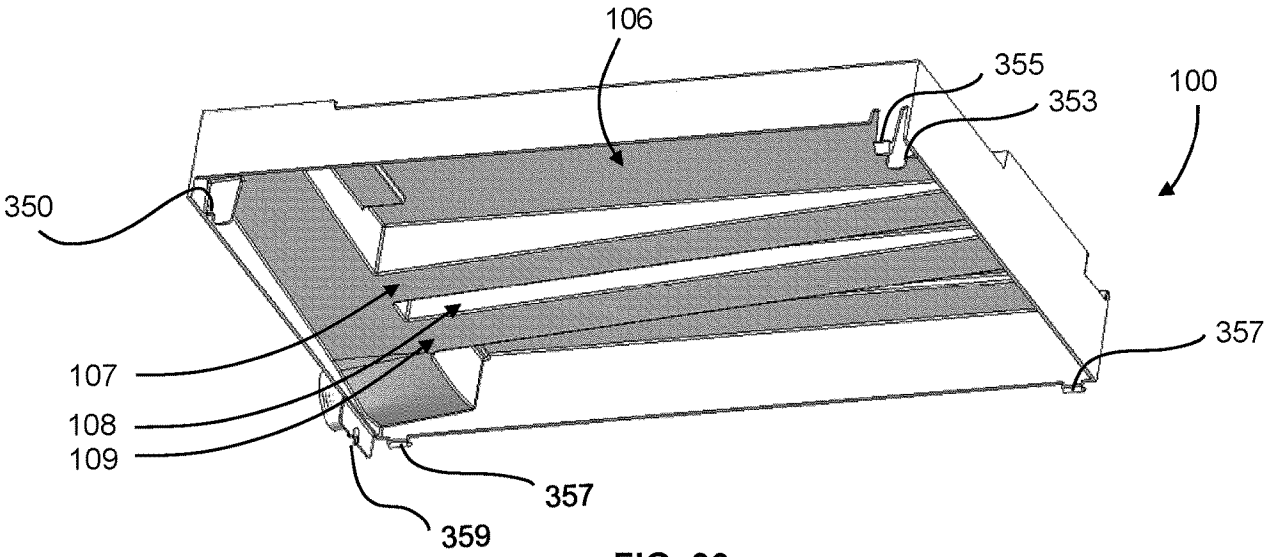
FIG. 36 is a bottom perspective view of the drain pan system of FIG. 5, according to an exemplary embodiment.

FIG. 36 shows a perspective view of a bottom region of drain pan system 100, according to an exemplary embodiment. As shown, the bottom region of drain pan system 100 includes recesses corresponding to each of seat 106, and channels 107, 108, and 109. Drain pan system 100 includes a plurality of attachment features to facilitate coupling of the insulation panel 345. As shown, drain pan system 100 includes locating tabs 350 and 353, which enable placement and/or positioning of insulation panel 345 within the bottom region of drain pan system 100 and the placement and/or positioning onto the unit base panel. Drain pan system 100 also includes locking tab 355, hook tabs 357, and mounting tab 359 which facilitate coupling of the drain pan system 100 to the unit base panel. In various embodiments, drain pan system 100 may include more or fewer attachment and/or positioning tabs.

Figure 37:
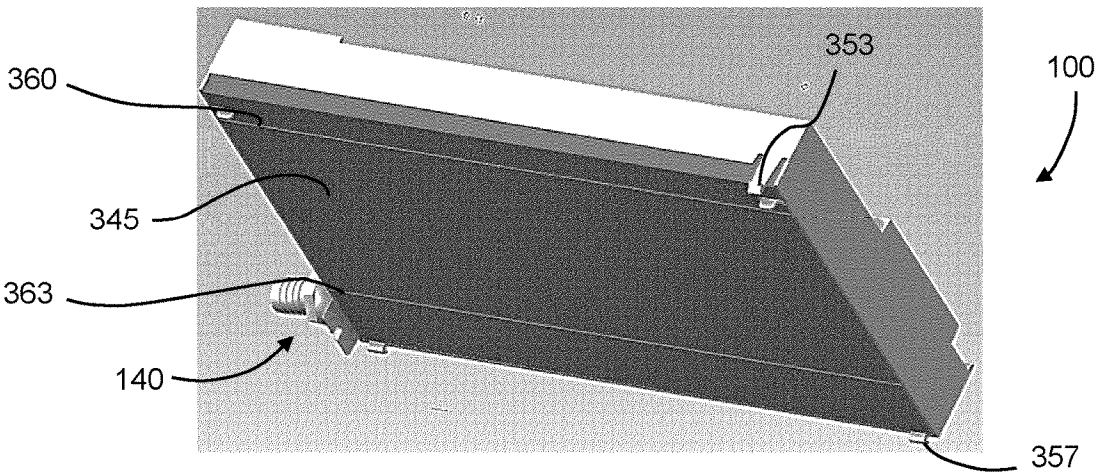
FIG. 37 is a bottom perspective view of the drain pan system of FIG. 5 with a coupled insulation panel, according to an exemplary embodiment.

FIG. 37 shows a perspective view of the bottom region of drain pan system 100 coupled to insulation panel 345. In various embodiments, panel 345 is fitted to the bottom region of drain pan system 100. In various embodiments, insulation panel 345 includes recesses and/o attachment points that correspond to tabs 353, 355, 357, and/or 359 and enable attachment of the insulation panel 345 to the bottom surface of the drain pan system 100. As shown, insulation panel 345 may include one or more ribs 360 and 363, which prevent air passage beneath the drain pan system 100.

In various embodiments, the components within drain pan system 100 may be comprised of metallic or non-metallic materials, or a combination thereof. In various embodiments, components within drain pan system 100 may be comprised of materials with antimicrobial properties. In some embodiments, components within drain pan system 100, such as well 130 and/or insert component 135, may be comprised of antimicrobial plastic. In other embodiments, the components of system 100 may be coupled via fasteners (e.g., rivets, screws, bolts, etc.) or fixed via welding, brazing, soldering, or any other suitable method. In various embodiments, portions or all of drain pan system 100 may be formed via injection molding.

Figure 39:
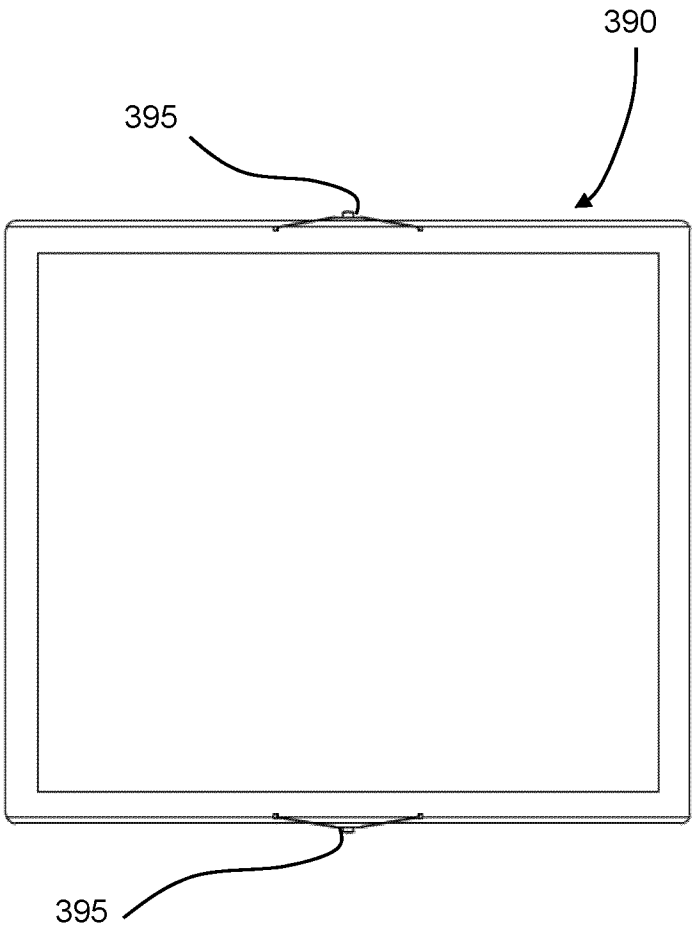
FIG. 39 depicts a filter for use in conjunction with the drain pan system, according to an exemplary embodiment.
Figure 38:
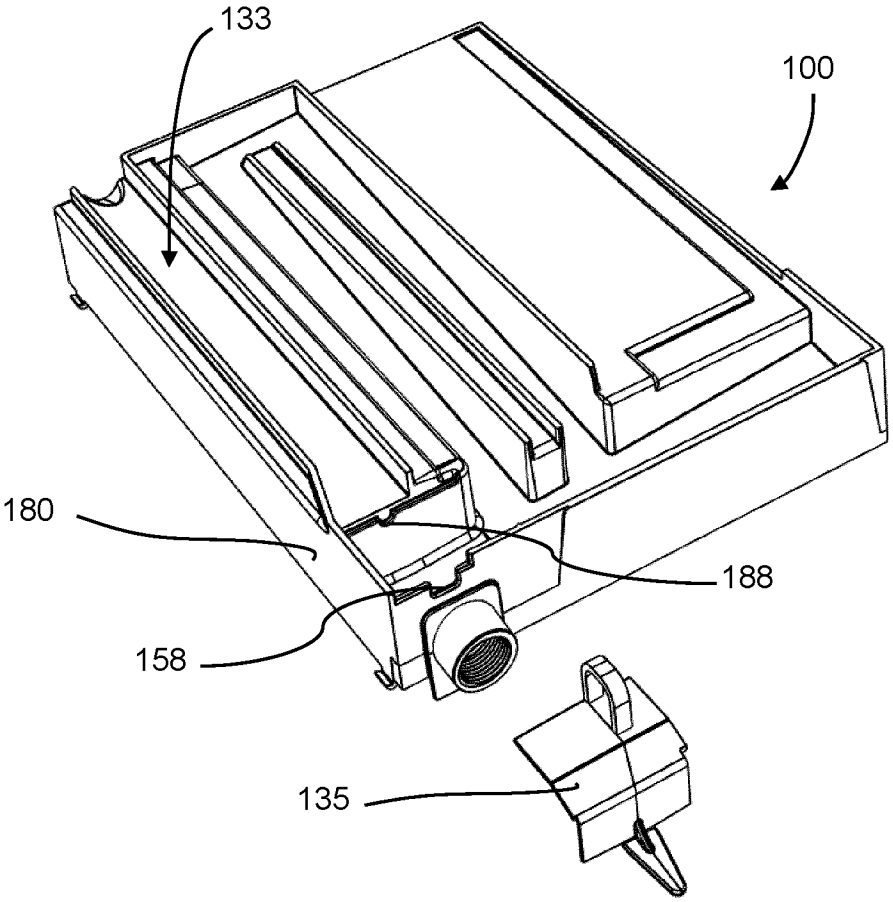
FIG. 38 is a perspective view of the drain pan system with the insert component removed, according to an exemplary embodiment.

FIG. 38 is a perspective view of the drain pan system 100 with the insert component 135 removed from drain pan 180, according to an exemplary embodiment. FIG. 39 depicts a filter 390 for use in conjunction with the drain pan system 100, according to an exemplary embodiment. Filter 390 includes one or more spring clips 395 extending from one or more surfaces of the filter 390. In an embodiment, spring clips 395 are configured to slide within corresponding channels of the drain pan 180 to facilitate installation of the filter and/or prevent installation of the filter in instances where the insert component 135 is not previously installed in the drain pan 180. As depicted in FIG. 38, the drain pan 180 includes a filter seat 133 configured to receive the filter 390. The drain pan further includes a first cut-out portion 158 and a second cut-out portion 188.

Figure 40A:
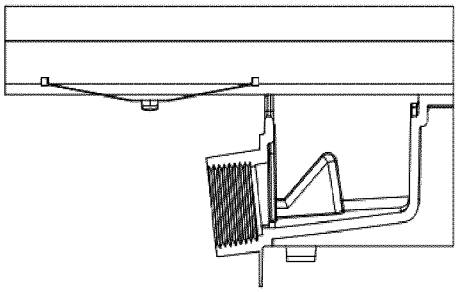
FIGS. 40A-40D depict a filter and drain pan system at varying points during an attempted installation of the filter with the insert component removed, according to an exemplary embodiment.
Figure 40B:
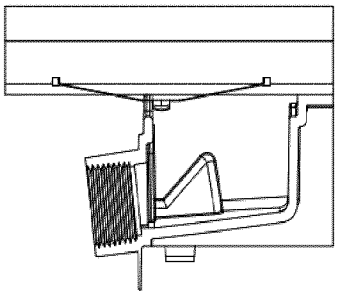
Figure 40C:
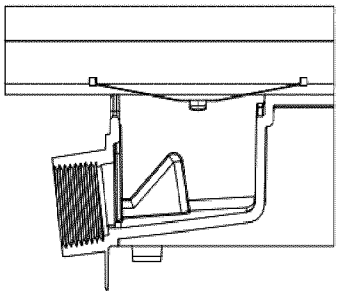
Figure 40D:
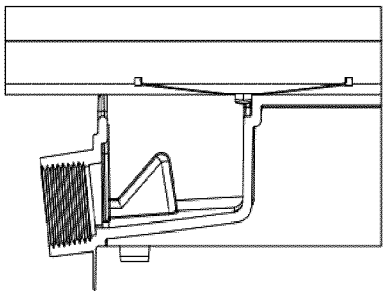

FIGS. 40A-40D depict the filter 390 and drain pan system 100 at varying points during an attempted installation of the filter 290 with the insert component 135 removed, according to an exemplary embodiment. As depicted in FIGS. 40A and 40B, the filter may be slid within the filter seat 133 such that the spring clip 395 passes through the first cut-out portion 158. When the insert component is absent from the drain pan system 100 as shown in FIGS. 40C and 40D, the spring clip 395 will contact the ledge of the filter seat 133 at the second cut-out portion 188, thereby preventing the filter 390 from being fully seated/installed.

Figure 41A:
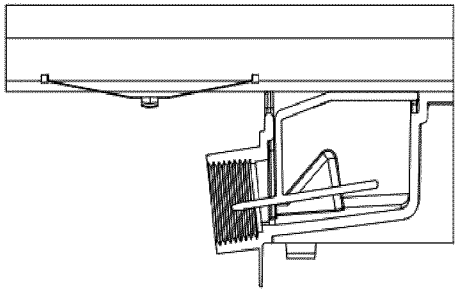
FIGS. 41A-41D depict a filter and drain pan system at varying points during an installation of the filter with the insert component installed in the drain pan, according to an exemplary embodiment.
Figure 41B:
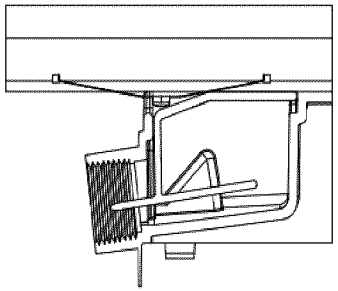
Figure 41C:
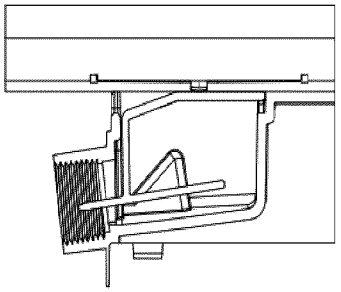
Figure 41D:
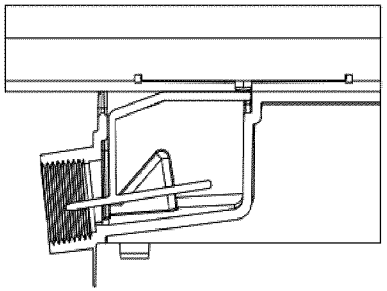

FIGS. 41A-41D depict the filter 390 and drain pan system 100 at varying points during an installation of the filter 290 with the insert component 135 already installed in the drain pan 180, according to an exemplary embodiment. As depicted in FIGS. 41A and 41B, the filter 390 may be slid into the filter seat 133 such that the spring clip 395 passes through the first cut-out portion 158 similar to FIGS. 40A And 40B. When the insert component is properly installed in the drain pan system 100 as shown in FIGS. 41C and 41D, the spring clip 395 will contact the sloped portion of insert component 135, causing compression of the spring clip 395. The spring clip 395 will slide along the sloped portion of the insert component 135 and onto the upper surface of the insert component 135. The upper surface of the spring clip 395 is similar in elevation to the filter seat 133, thereby allowing the spring clip 395 to be slid along the upper surface of the insert component 395 and onto the filter seat 133. As such, the filter 390 may be installed when the insert component 395 is properly seated within the drain pan 180, but prevented from installation when the insert component 395 is missing.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the application as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the apparatus and control system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments.

Other substitutions, modifications, changes and omissions may also be made in the design, operating conditions and arrangement of the various exemplary embodiments without departing from the scope of the present application. For example, any element disclosed in one embodiment may be incorporated or utilized with any other embodiment disclosed herein.

What is claimed is:

1. A drain pan system, comprising:
- a first wall;
- a second wall;
- wherein each of the first wall and the second wall is positioned substantially perpendicular to a bottom surface, and wherein each of the first wall and the second wall has a first height;
- a first channel defined by the first wall and the second wall and having a first end and a second end;
- a third wall having a second height, wherein the second height is greater than the first height;
- a well fluidly coupled to each of the first wall, the second wall, and the first channel; and
- an opening fluidly coupled to the well;
- wherein each of the first wall, second wall, and third wall are substantially parallel.

2. The system of claim 1, wherein the first channel has a first depth, wherein the first depth corresponds to a distance between the bottom surface and a top edge of the first wall.

3. The system of claim 2, further comprising a second channel defined by the second wall and fourth wall, wherein the fourth wall is disposed between the second wall and third wall.

4. The system of claim 3, wherein the second channel has a second depth, wherein the second depth corresponds to a distance between a bottom surface and a top edge of the second wall.

5. The system of claim 4, wherein the second channel depth is less than the first channel depth.

6. The system of claim 3, wherein the second wall is substantially equidistant from the first wall and the fourth wall.

7. The system of claim 3, further comprising a third channel defined by the fourth wall and the third wall.

8. The system of claim 1, further comprising an insert component coupled between the well and the opening, wherein the insert component is configured to control a flow of condensate through a drain opening.

9. A system, comprising:
- a condensate generating apparatus comprising:
  - an evaporator having a first location and a second location;
  - a condenser; and
  - a third location defined by a space between the evaporator and the condenser;
- a drain pan comprising:
  - a first wall having a first position corresponding to the first location;
  - a second wall having a second position corresponding to the second location;
  - a channel defined by the first wall and the second wall;
  - a third wall having a third position corresponding to the third location;
  - a well fluidly coupled to each of the first wall, the second wall, and the channel; and;
- an opening fluidly coupled to the well.

10. The system of claim 9, wherein each of the first wall and the second wall have a same first height.

11. The system of claim 10, wherein the third wall has a second height, and wherein the second height is greater than the first height.

12. The system of claim 9, wherein the drain pan further comprises an insert component positioned between the well and the opening.

13. The system of claim 12, wherein the insert component comprises a handle, a horizontal portion connected to the handle, and an angled portion connecting the horizontal portion to a vertical portion, wherein the vertical portion is connected to a slanted portion of the insert component.

* * * * *